US007641072B1

(12) United States Patent
Vlastakis et al.

(10) Patent No.: US 7,641,072 B1
(45) Date of Patent: Jan. 5, 2010

(54) THEFT DETERRENT SYSTEM

(75) Inventors: Kirk Vlastakis, Clemmons, NC (US); Roger K. Miller, East Bend, NC (US); Thomas A. Lockwood, Clemmons, NC (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 211 days.

(21) Appl. No.: 11/528,032

(22) Filed: Sep. 27, 2006

Related U.S. Application Data

(63) Continuation-in-part of application No. 10/967,811, filed on Oct. 18, 2004, and a continuation-in-part of application No. 11/409,855, filed on Apr. 24, 2006, now abandoned.

(60) Provisional application No. 60/512,454, filed on Oct. 17, 2003, provisional application No. 60/674,880, filed on Apr. 25, 2005, provisional application No. 60/720,823, filed on Sep. 27, 2005.

(51) Int. Cl.

| | |
|---|---|
| ***B65H 3/44*** | (2006.01) |
| ***B65H 3/00*** | (2006.01) |
| ***B65H 1/08*** | (2006.01) |
| ***G07F 11/16*** | (2006.01) |

(52) U.S. Cl. ..... 221/123; 221/263; 221/3; 221/192; 221/232; 221/254; 221/276; 221/279; 221/229; 312/71; 312/35

(58) Field of Classification Search ..... 221/3, 221/192, 263, 232, 254, 123, 276, 229, 279, 221/282; 74/483; 312/71, 35

See application file for complete search history.

(56) References Cited

U.S. PATENT DOCUMENTS

| | | | | |
|---|---|---|---|---|
| 691,990 | A | | 1/1902 | Warren |
| 1,034,318 | A | | 7/1912 | Sobretto et al. |
| 1,123,071 | A | | 12/1914 | Bell |
| 1,319,084 | A | | 10/1919 | Hume |
| 1,533,147 | A | | 4/1925 | Svendsgaard |
| 1,592,720 | A | | 7/1926 | Butler |
| 1,614,363 | A | | 1/1927 | Hicks |
| 1,680,275 | A | | 8/1928 | Albaugh |
| 1,755,655 | A | | 4/1930 | Langenfeld |
| 1,813,935 | A | | 7/1931 | Knee |
| 1,841,926 | A | | 1/1932 | Wray |
| 1,913,843 | A | | 6/1933 | Marcuse |
| 2,142,053 | A | * | 12/1938 | Hoban ..... 221/286 |
| 2,163,280 | A | | 6/1939 | Hibshman |
| 2,304,533 | A | | 12/1942 | Bright |

(Continued)

FOREIGN PATENT DOCUMENTS

DE 20 2005 010 088 U1 10/2005

(Continued)

*Primary Examiner*—Gene O. Crawford
*Assistant Examiner*—Rakesh Kumar
(74) *Attorney, Agent, or Firm*—Kilpatrick Stockton LLP

(57) ABSTRACT

Systems for deterring theft of retail products. Systems of this invention provide theft deterrent cabinets for dispensing products and may incorporate theft deterrent measures including mechanical deterrents, time delays and sound.

18 Claims, 21 Drawing Sheets

U.S. PATENT DOCUMENTS

| | | | | |
|---|---|---|---|---|
| 2,412,368 | A | 12/1946 | Tascher | |
| 2,824,666 | A | 2/1958 | Hausladen | |
| 2,977,023 | A | 3/1961 | Meyer | |
| 3,161,295 | A | 12/1964 | Chesley | |
| 3,199,724 | A | 8/1965 | Domenico et al. | |
| 3,313,448 | A | 4/1967 | Howard et al. | |
| 3,351,233 | A | 11/1967 | Chanoch et at | |
| 3,452,899 | A | 7/1969 | Libberton | |
| 3,578,207 | A | 5/1971 | Danow | |
| 3,583,568 | A | 6/1971 | Crosslen | |
| 3,591,048 | A | 7/1971 | Myers | |
| 3,749,279 | A | 7/1973 | Ungerman | |
| 3,752,357 | A | 8/1973 | Harris | |
| 3,776,418 | A | 12/1973 | Bookout | |
| 3,796,345 | A | 3/1974 | Fessler | |
| 3,805,962 | A | 4/1974 | Bendiksen | |
| 3,923,159 | A | 12/1975 | Taylor et al. | |
| 3,957,173 | A | 5/1976 | Roudebush | |
| 3,968,900 | A | 7/1976 | Stambuk | |
| 4,007,853 | A * | 2/1977 | Bahneman | 221/3 |
| 4,010,869 | A | 3/1977 | Adamo | |
| 4,018,100 | A * | 4/1977 | Moe | 74/483 PB |
| 4,190,179 | A | 2/1980 | Moss et al. | |
| 4,228,903 | A | 10/1980 | Eckert | |
| 4,275,819 | A | 6/1981 | Perez | |
| 4,308,974 | A | 1/1982 | Jones | |
| 4,336,892 | A | 6/1982 | Cox et al. | |
| 4,371,093 | A * | 2/1983 | Berger | 221/90 |
| 4,412,607 | A | 11/1983 | Collins et al. | |
| 4,474,300 | A | 10/1984 | Entis | |
| 4,576,272 | A | 3/1986 | Morgan et al. | |
| 4,679,684 | A | 7/1987 | Glaser | |
| 4,682,826 | A | 7/1987 | Mestdagh | |
| 4,779,760 | A | 10/1988 | Wittern et al. | |
| 4,852,767 | A | 8/1989 | Humphrey | |
| 4,887,737 | A * | 12/1989 | Adenau | 221/3 |
| 4,954,760 | A | 9/1990 | Futch et al. | |
| 4,962,867 | A | 10/1990 | Ficken et al. | |
| 5,046,641 | A | 9/1991 | Gray | |
| 5,067,634 | A | 11/1991 | Guindulain Vidondo | |
| 5,096,367 | A | 3/1992 | Winski | |
| 5,111,942 | A | 5/1992 | Bernardin | |
| 5,121,854 | A | 6/1992 | Trouteaud et al. | |
| 5,150,101 | A | 9/1992 | Goris et al. | |
| 5,169,027 | A | 12/1992 | Falk et al. | |
| 5,199,598 | A | 4/1993 | Sampson | |
| 5,229,749 | A | 7/1993 | Yenglin | |
| 5,240,126 | A | 8/1993 | Foster et al. | |
| 5,249,705 | A | 10/1993 | Gates | |
| 5,252,948 | A | 10/1993 | Goris et al. | |
| 5,263,596 | A * | 11/1993 | Williams | 221/153 |
| 5,269,597 | A * | 12/1993 | Yenglin et al. | 312/42 |
| 5,285,926 | A | 2/1994 | Falk et al. | |
| 5,335,816 | A | 8/1994 | Kaufman et al. | |
| 5,335,818 | A | 8/1994 | Maldanis | |
| 5,360,134 | A | 11/1994 | Falk | |
| 5,375,735 | A | 12/1994 | Huvey et al. | |
| 5,375,737 | A | 12/1994 | Ficken | |
| 5,397,025 | A | 3/1995 | Lee | |
| 5,400,919 | A | 3/1995 | Gomm et al. | |
| 5,439,136 | A | 8/1995 | Chatani et al. | |
| 5,462,198 | A | 10/1995 | Schwimmer | |
| 5,632,408 | A | 5/1997 | Mitchell | |
| 5,665,304 | A | 9/1997 | Heinen et al. | |
| 5,709,315 | A * | 1/1998 | Kahler et al. | 221/155 |
| 5,790,409 | A | 8/1998 | Fedor et al. | |
| 5,813,568 | A | 9/1998 | Lowing | |
| 5,960,984 | A | 10/1999 | Weston | |
| 5,960,988 | A * | 10/1999 | Freixas | 221/13 |
| 6,131,748 | A | 10/2000 | Kawasaki et al. | |
| 6,176,558 | B1 * | 1/2001 | Hlade et al. | 312/42 |
| 6,196,416 | B1 | 3/2001 | Seagle | |
| 6,199,720 | B1 | 3/2001 | Rudick et al. | |
| 6,206,237 | B1 | 3/2001 | Dillon et al. | |
| 6,241,121 | B1 | 6/2001 | Yasaka | |
| 6,263,259 | B1 | 7/2001 | Bartur | |
| 6,318,591 | B1 | 11/2001 | Martin | |
| 6,325,242 | B1 * | 12/2001 | Izawa et al. | 221/197 |
| 6,464,089 | B1 | 10/2002 | Rankin | |
| 6,474,478 | B1 | 11/2002 | Huchner et al. | |
| 6,478,187 | B2 | 11/2002 | Simson et al. | |
| 6,520,604 | B1 | 2/2003 | Yasaka et al. | |
| 6,581,798 | B2 | 6/2003 | Liff et al. | |
| 6,601,416 | B1 | 8/2003 | Sanders | |
| 6,604,652 | B1 | 8/2003 | Trautwein | |
| 6,622,979 | B2 | 9/2003 | Valiulis | |
| 6,659,291 | B2 | 12/2003 | Huchner et al. | |
| 6,691,891 | B2 | 2/2004 | Maldonado | |
| D491,403 | S | 6/2004 | Gervasi | |
| 6,758,370 | B2 | 7/2004 | Cooke et al. | |
| 6,776,304 | B2 | 8/2004 | Liff et al. | |
| 6,786,341 | B2 | 9/2004 | Stinnett et al. | |
| 6,814,254 | B2 | 11/2004 | Liff et al. | |
| 6,814,255 | B2 | 11/2004 | Liff et al. | |
| 6,857,539 | B2 | 2/2005 | Parra | |
| 6,892,898 | B1 | 5/2005 | Boone et al. | |
| 6,957,555 | B1 | 10/2005 | Nagel et al. | |
| 7,007,810 | B2 | 3/2006 | Huehner et al. | |
| 7,024,894 | B2 | 4/2006 | Salonen | |
| 7,032,776 | B2 | 4/2006 | Hieb | |
| D521,363 | S | 5/2006 | Copen et al. | |
| 7,128,221 | B2 | 10/2006 | Metcalf | |
| 7,128,239 | B2 | 10/2006 | Skavnak | |
| 7,149,600 | B2 | 12/2006 | Rippolone | |
| 7,151,982 | B2 | 12/2006 | Liff et al. | |
| 7,178,678 | B2 | 2/2007 | Mansfield et al. | |
| 7,197,902 | B1 | 4/2007 | Barkdoll | |
| 7,207,447 | B2 | 4/2007 | Medcalf et al. | |
| 7,213,722 | B2 | 5/2007 | Nagelski et al. | |
| 7,246,711 | B1 | 7/2007 | Metcalf | |
| 7,249,761 | B2 | 7/2007 | Graef et al. | |
| 7,264,138 | B2 | 9/2007 | Collins et al. | |
| 7,269,983 | B1 | 9/2007 | Mchatet | |
| 7,293,672 | B2 | 11/2007 | Mori | |
| 7,303,095 | B2 | 12/2007 | Nagelski | |
| 7,533,784 | B2 | 5/2009 | Vlastakis et al. | |
| 2003/0029816 | A1 | 2/2003 | Huchner et al. | |
| 2003/0121929 | A1 | 7/2003 | Liff et al. | |
| 2003/0178435 | A1 | 9/2003 | Yamaguchi | |
| 2003/0189058 | A1 | 10/2003 | Liff et al. | |
| 2004/0026344 | A1 | 2/2004 | Sedon et al. | |
| 2004/0059464 | A1 | 3/2004 | Veenstra et al. | |
| 2004/0060944 | A1 | 4/2004 | Gervasi | |
| 2004/0084386 | A1 | 5/2004 | Huchner et al. | |
| 2004/0104239 | A1 | 6/2004 | Black et al. | |
| 2004/0149768 | A1 | 8/2004 | Scoville et al. | |
| 2004/0238557 | A1 | 12/2004 | Chirnomas | |
| 2005/0029205 | A1 | 2/2005 | Mansfield et al. | |
| 2005/0029283 | A1 | 2/2005 | Pedigo | |
| 2005/0065645 | A1 | 3/2005 | Liff et al. | |
| 2005/0189369 | A1 | 9/2005 | Vlastakis | |
| 2005/0189370 | A1 | 9/2005 | Carter et al. | |
| 2005/0199644 | A1 | 9/2005 | Barili et al. | |
| 2005/0205596 | A1 | 9/2005 | Kelly | |
| 2005/0252925 | A1 | 11/2005 | Kelly | |
| 2006/0157431 | A1 | 7/2006 | Nagelski et al. | |
| 2006/0219730 | A1 | 10/2006 | Handfield et al. | |
| 2006/0237381 | A1 | 10/2006 | Lockwood | |
| 2006/0266762 | A1 | 11/2006 | Andrews et al. | |
| 2007/0029340 | A1 | 2/2007 | Nagelski et al. | |
| 2007/0078561 | A1 | 4/2007 | Sansone | |
| 2007/0080175 | A1 | 4/2007 | Peterson | |
| 2007/0119796 | A1 | 5/2007 | Barkdoll | |
| 2007/0221679 | A1 | 9/2007 | Chandler et al. | |

| | | | |
|---|---|---|---|
| 2007/0273513 | A1 | 11/2007 | White |
| 2007/0278164 | A1 | 12/2007 | Lang et al. |
| 2007/0283615 | A1 | 12/2007 | Vlastakis |
| 2008/0142538 | A1 | 6/2008 | Miller |

FOREIGN PATENT DOCUMENTS

| | | | |
|---|---|---|---|
| DE | 20 2005 019 621 | U1 | 3/2006 |
| DE | 20 2007 011 927 | U1 | 12/2007 |
| EP | 1 541 064 | B1 | 6/2005 |
| JP | 01144185 | | 6/1989 |
| JP | 02219194 | | 8/1990 |
| JP | 09319937 | | 12/1997 |
| JP | 2005049965 | | 1/2005 |
| JP | 2006285930 | | 10/2006 |
| WO | WO 8912873 | | 12/1989 |
| WO | WO 2007/054042 | A1 | 5/2007 |
| WO | WO 2006/085211 | A1 | 8/2007 |

* cited by examiner

THEFT DETERRENT SYSTEM

CROSS-REFERENCE TO RELATED APPLICATIONS

This application claims the benefit of U.S. Provisional Application No. 60/720,823, filed Sep. 27, 2005. This application is a continuation-in-part application of U.S. application Ser. No. 10/967,811, filed Oct. 18, 2004, which claims priority to U.S. Application Ser. No. 60/512,454, filed on Oct. 17, 2003. This application is also a continuation-in-part application of U.S. application Ser. No. 11/409,885, filed Apr. 24, 2006, now abandoned which claims priority to U.S. Application Ser. No. 60/674,880, filed Apr. 25, 2005.

BACKGROUND

1. Field of the Invention

The invention relates generally to theft deterrent systems for dispensing products. More specifically, the invention relates to dispensing devices that incorporate theft deterrent measures, such as time delays and sound.

2. General Background

Theft of small items in retail stores is an all too common problem. Items that are in high demand by thieves include over-the-counter (OTC) products such as analgesics and cough and cold medications, razor blades, camera film, batteries, videos, DVDs, smoking cessation products and infant formula. Shelf sweeping is a particular problem for small items. Shelf sweeping occurs when individuals or groups remove all the shelf stock and exit the store, similar to a "smash and grab" shoplifting technique. Shelf sweeping relies on excessive quantities of product being available on the shelf. Retailers must keep substantial inventory on shelf or incur the cost of constantly restocking.

In addition to preventing theft, retail stores may want to limit the purchase of certain items. For example, to make methamphetamine, large quantities of cold medication are needed. Pseudoephedrine, the sole active ingredient in many cold medicines and decongestants, is also a key ingredient in methamphetamine, a powerful and highly addictive stimulant.

Retailers are constantly challenged to balance the needs of legitimate consumers' access to high theft items with measures to minimize the incidence of theft. It has long been known to place items such as cigarettes, sodas and newspapers in vending machines. Such machines require complete self-service by the customer. The customer places money into the vending machine and the machine dispenses the desired item. Typical vending machines, however, do not allow for variation in product size and can only vend the particular item that they were designed for. Additionally, typical vending machines may be inconsistent with the way that people currently purchase items; many people prefer to use credit or debit cards instead of cash. May vending machines also occupy a great deal of space. Finally, typical vending machines do not employ any mechanism to prevent a purchaser from quickly dispensing all the items in the vending machine.

Because theft has become so rampant in certain product categories, such as razors and infant formula, many retail stores are taking the products off the shelves and placing them behind the counter or under lock and key. Customers must request the products in order to make a purchase. This requires additional labor costs to provide individual service to customers who would normally not require it. It also makes it difficult for customers to compare products. Furthermore, it may be impossible where the space behind the counter is limited and is needed for prescription medications. In some cases, products are simply unavailable due to high pilferage rates. Therefore, a device or dispensing apparatus that minimizes the incidence of product theft is needed.

A common problem at pharmacies and grocery stores is ensuring that consumers have access to cold medication or razors, but at the same time deterring theft or multiple purchases for the production of drugs. A solution to the problem of sweeping is to limit the amount of product each customer is allowed to purchase. However, this requires additional labor and is not feasible where many stores now allow customers the option to check themselves out without the help of a cashier. Furthermore, this solution also keeps lawful products out of the hands of lawful consumers. Finally, legislation may be required in order to limit such purchases. A device or dispensing apparatus that minimizes the likelihood of sweeping or unusually high numbers of multiple purchases is needed.

Such a device or dispensing apparatus should also be able to fit within common grocery, drug store or other retail environment shelves. It is also desirable that the device or dispensing apparatus effectively display the products so consumers can easily identify the products. It is also preferable that the dispensing apparatus be easy to use.

SUMMARY

Embodiments of this invention provide a system for dispensing product that deters theft of the product while also providing a dispensing system that is easy to use. Embodiments of this invention may include one or more cabinet assembly units, which includes one or more dispenser modules. Each dispenser module generally includes a door assembly, a lockout assembly and side panels and houses at least one pusher assembly. Cabinet assembly units of this invention are easily adjustable, so that they may easily be restocked and reconfigured.

Certain embodiments of systems of this invention may incorporate a time delay feature, which requires someone who wants to remove more than one product from a dispenser to wait for several seconds between removal of each product. Certain systems of this invention may also include a lockout feature, so that one only pusher assembly may be activated to dispense a product at one time. In addition, some embodiments of this invention may include a drop down door, keyed locks and other mechanisms that prevent access to the product storage portion of the system.

DETAILED DESCRIPTION

Embodiments of the invention will now be described more fully with reference to the drawings.

Theft deterrent systems of this invention include one or more cabinet assembly units for dispensing products and for deterring theft of products. Theft deterrent systems of this invention may be configured so that only one product per dispenser may be removed at a time and only when the product is at the front of the assembly. This requires someone who wants to remove more than one product from a dispenser to wait for several seconds between removal of each product, which has been found to be a substantial deterrence to product theft.

Figure 1:
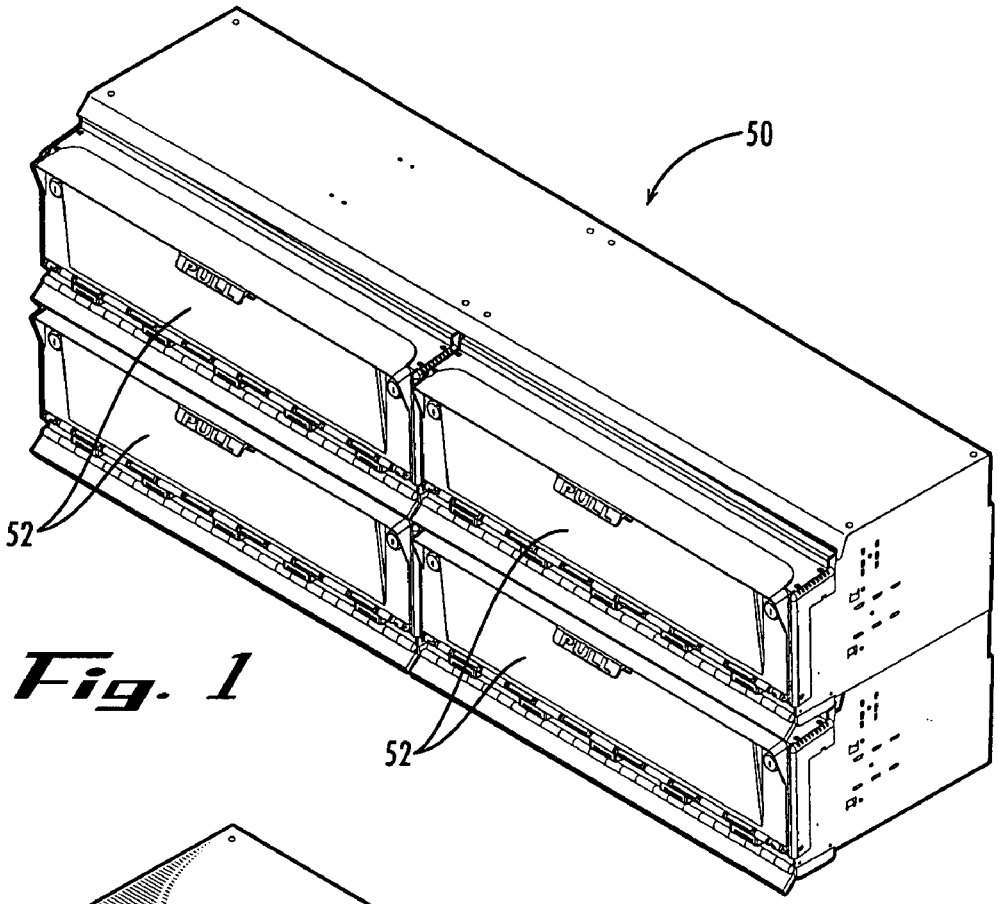
FIG. 1 is a front perspective view of a cabinet assembly of a theft deterrent system according to certain embodiments of the invention.
Figure 3:
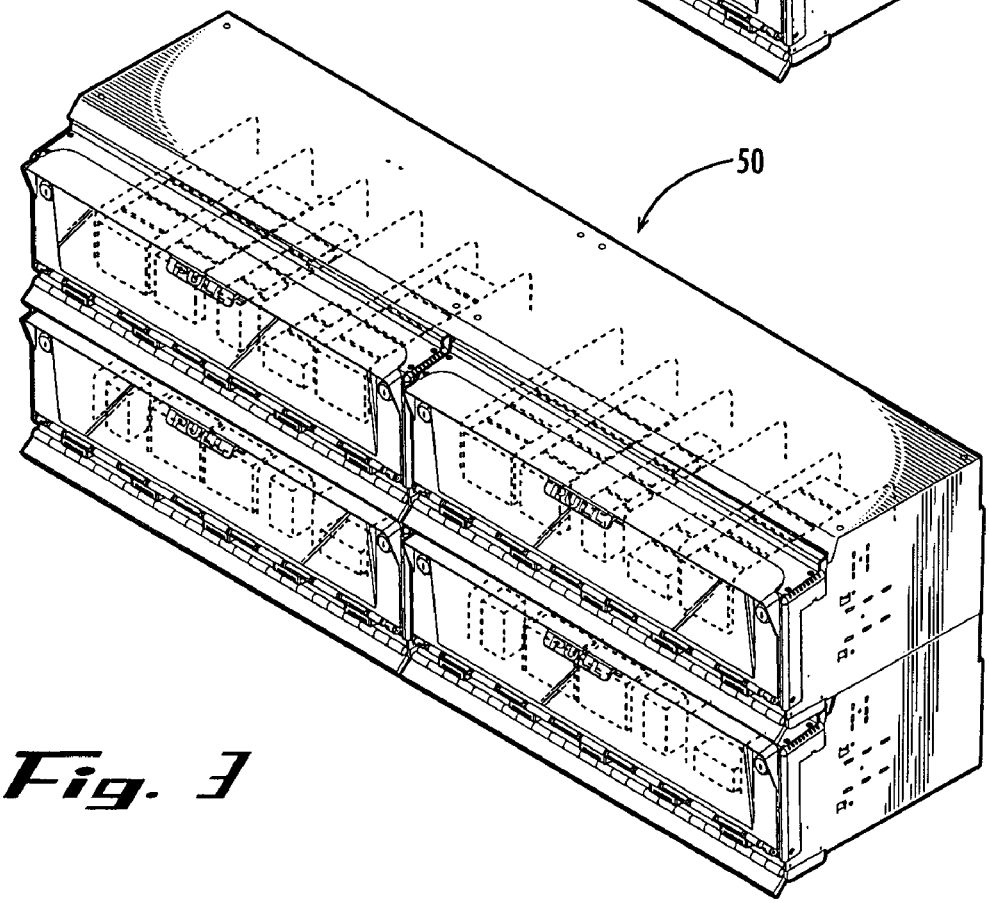
FIG. 3 is a front perspective view of the assembly of FIG. 1, in a starting position before products, which are shown by broken lines, are dispensed.
Figure 2:
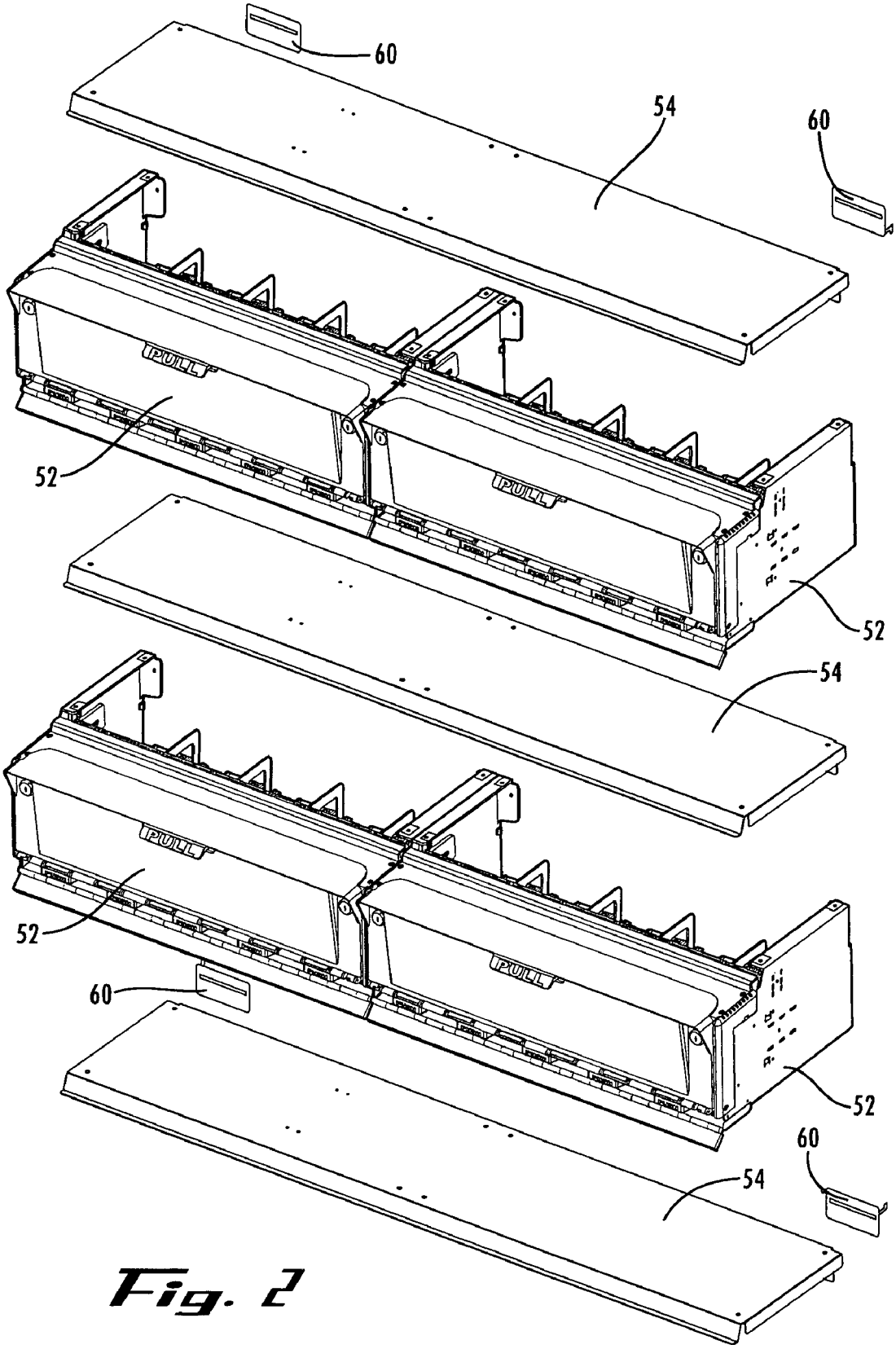
FIG. 2 is an exploded view of the assembly of FIG. 1.
Figure 4:
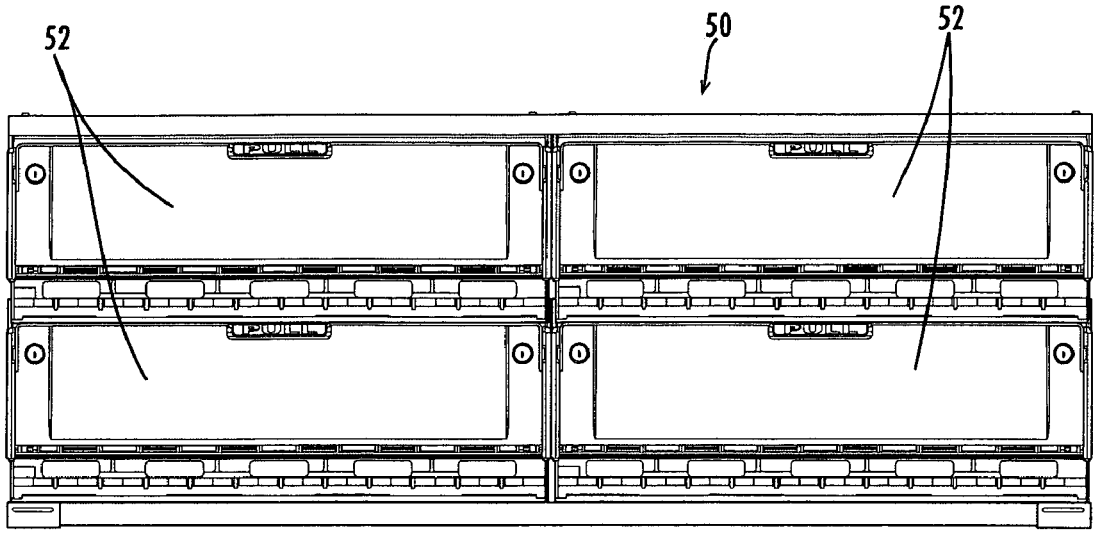
FIG. 4 is a front view of the assembly of FIG. 1.
Figure 5:
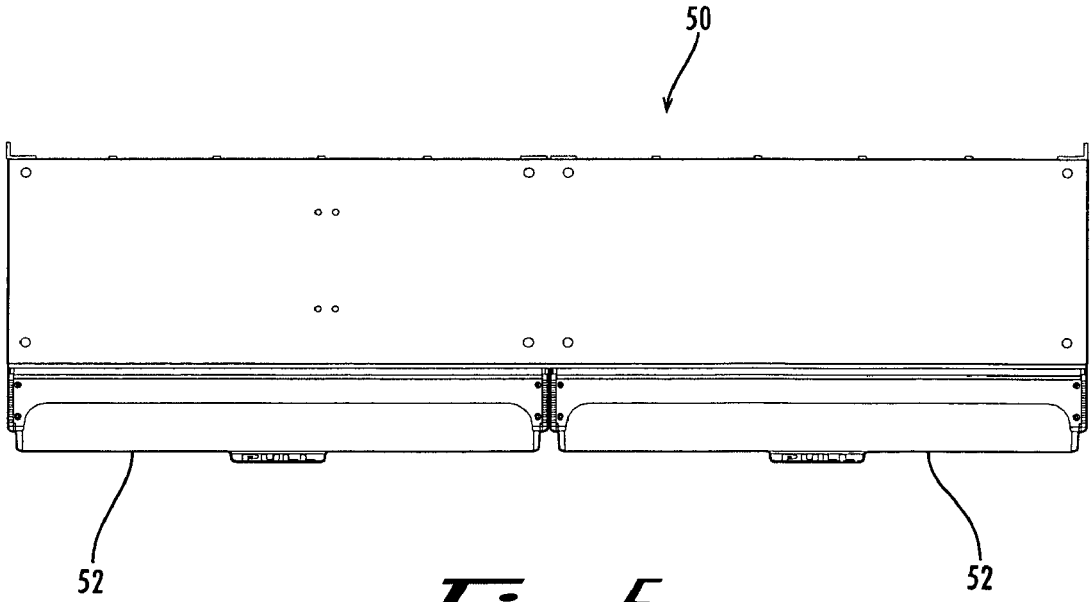
FIG. 5 is a top view of the assembly of FIG. 1.
Figure 6:
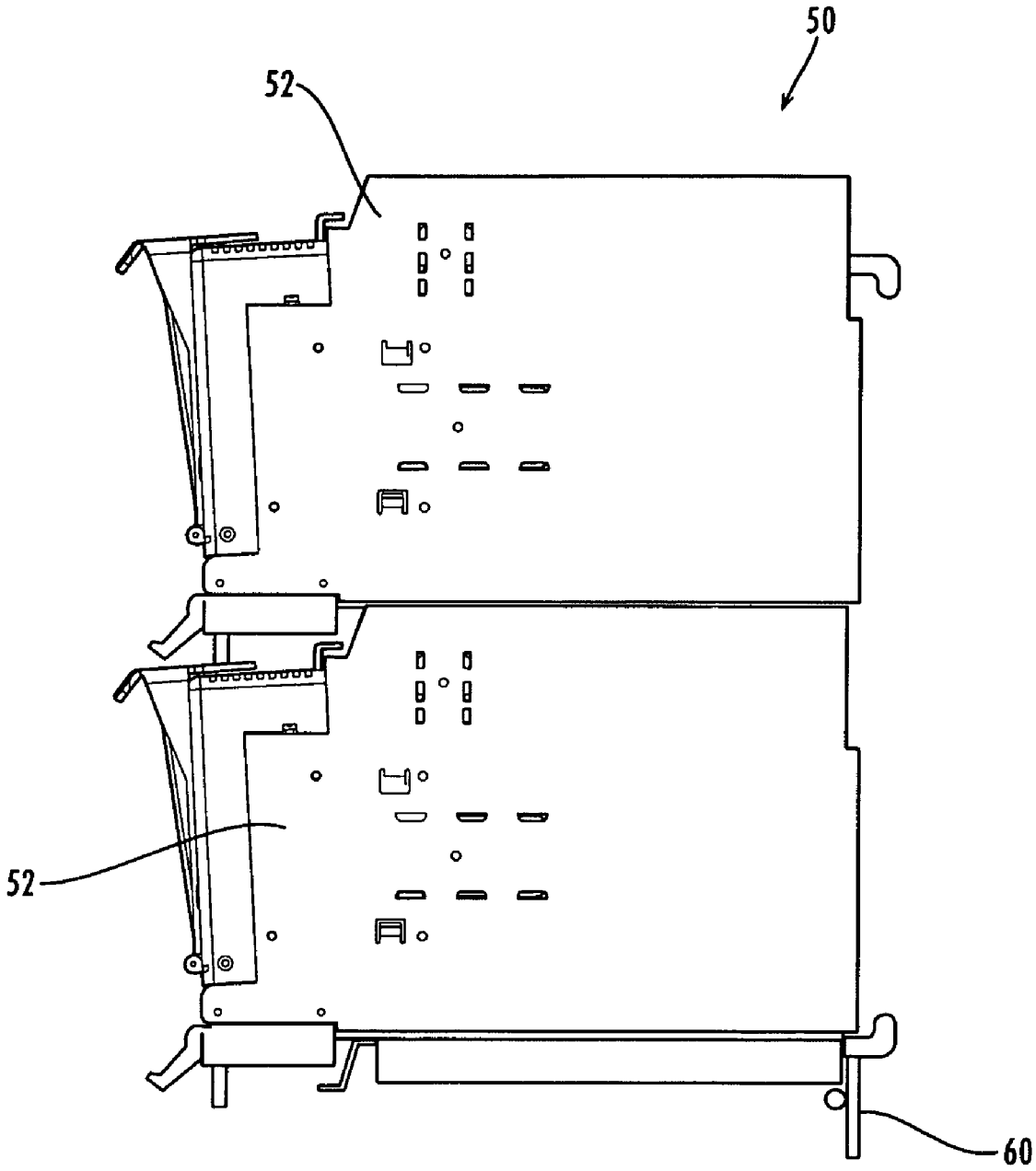
FIG. 6 is an end view of the assembly of FIG. 1.

A theft deterrent system of this invention may include a cabinet assembly, which includes one or more dispenser modules. In certain embodiments as shown in the drawings, the cabinet assembly 50 includes four dispenser modules 52. In other embodiments, cabinet assembly units may include various numbers of dispenser modules. As shown in FIG. 2, two dispenser modules 52 are separated from two additional dispenser modules 52 by a shelf 54. Additional shelves 54 form the top and bottom of the cabinet assembly 50. Shelves 54 may be fastened to the dispenser modules 52 using any suitable securing mechanism, such as a lock nut and truss head screw.

A cabinet assembly of this invention may be pre-manufactured and pre-assembled, obviating the need to use existing store shelves. As shown in FIG. 2, hangers 60 attached to the rear wall of cabinet assembly 50 may be used to install the cabinet assembly 50. Hangers 60 are sized to fit into existing standard shelving backs. According to certain alternative embodiments, a cabinet assembly may include a single dispenser unit and may be formed to fit into existing shelving, or may be formed as a "free standing" unit.

Figure 7:
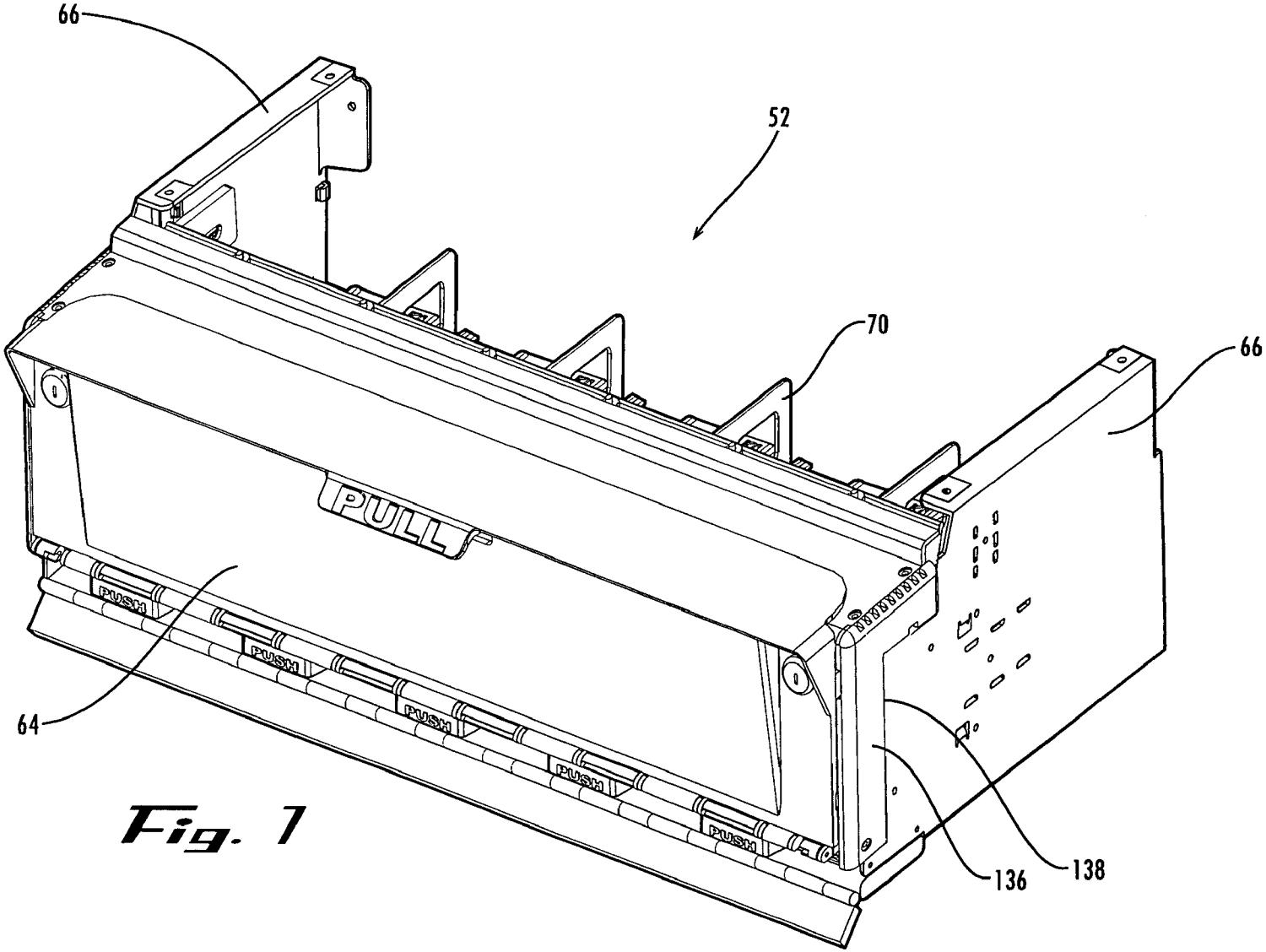
FIG. 7 is a front perspective view of one anti-theft module assembly according to certain embodiments of the invention.
Figure 8:
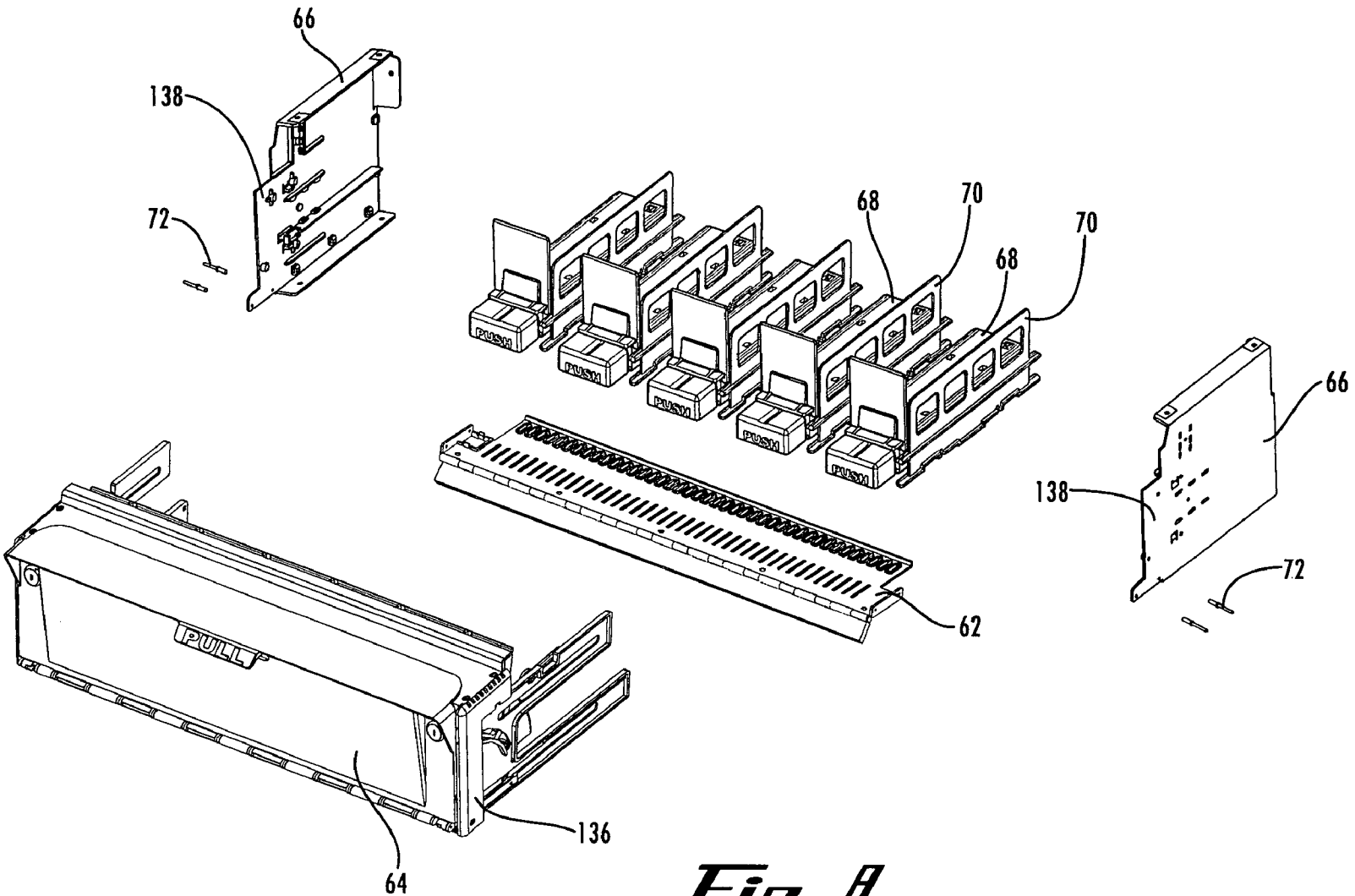
FIG. 8 is an exploded view of the module assembly of FIG. 7.
Figure 9:
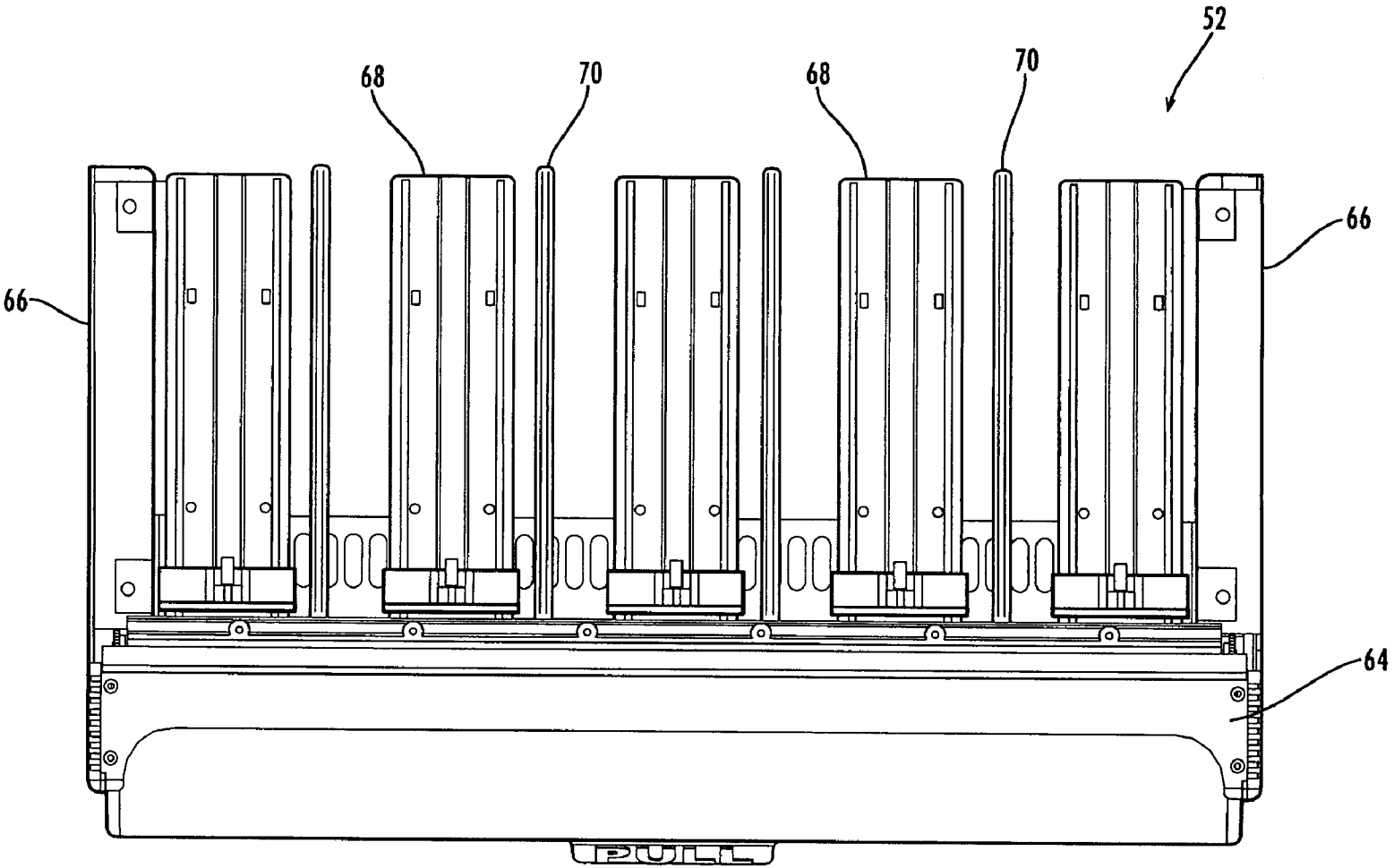
FIG. 9 is a top view of the module assembly of FIG. 7.
Figure 15:
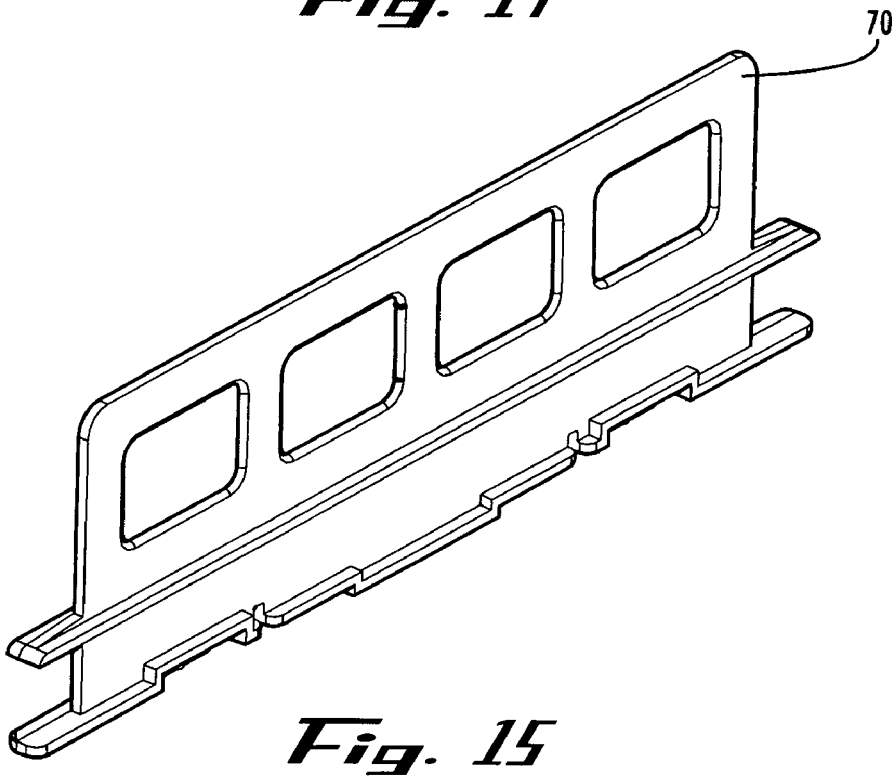
FIG. 15 is a perspective view of a divider of FIG. 7.
Figure 16:
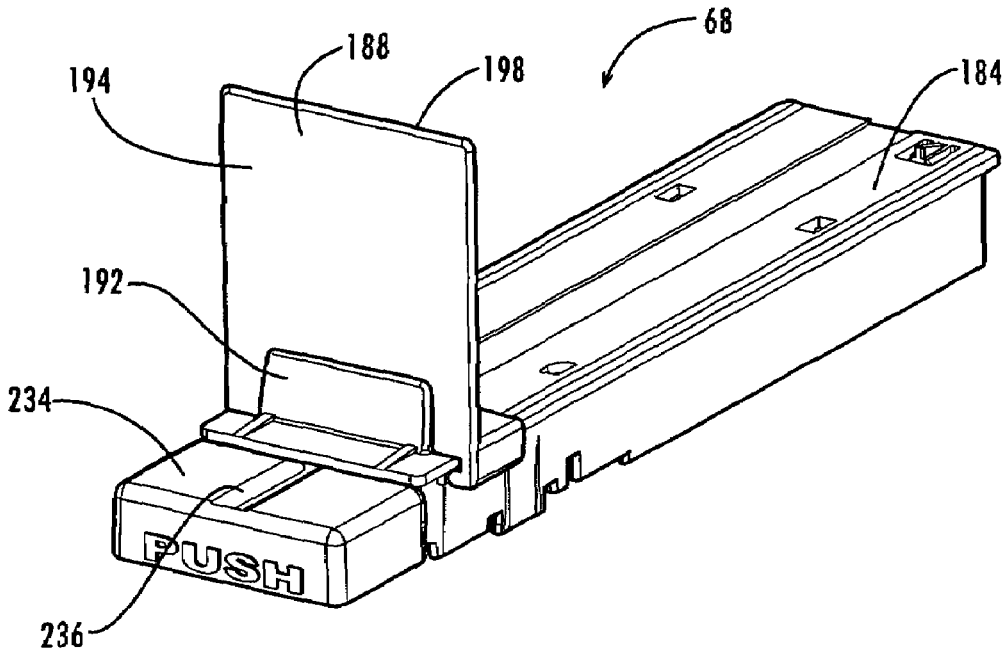
FIG. 16 is a perspective view of a pusher assembly of FIG. 8.

A single dispenser module 52 is shown in detail in FIGS. 7-9. Dispenser module 52 includes a lockout assembly 62, a door assembly 64, side panel members 66, and a plurality of pusher assembly units 68 which are separated by dividers 70 (also shown in FIG. 15). The lockout assembly 62, door assembly 64 and side panel members 66 may be joined using any suitable mechanical fastener, such as blind rivets 72, as shown in the drawings.

Figure 10:
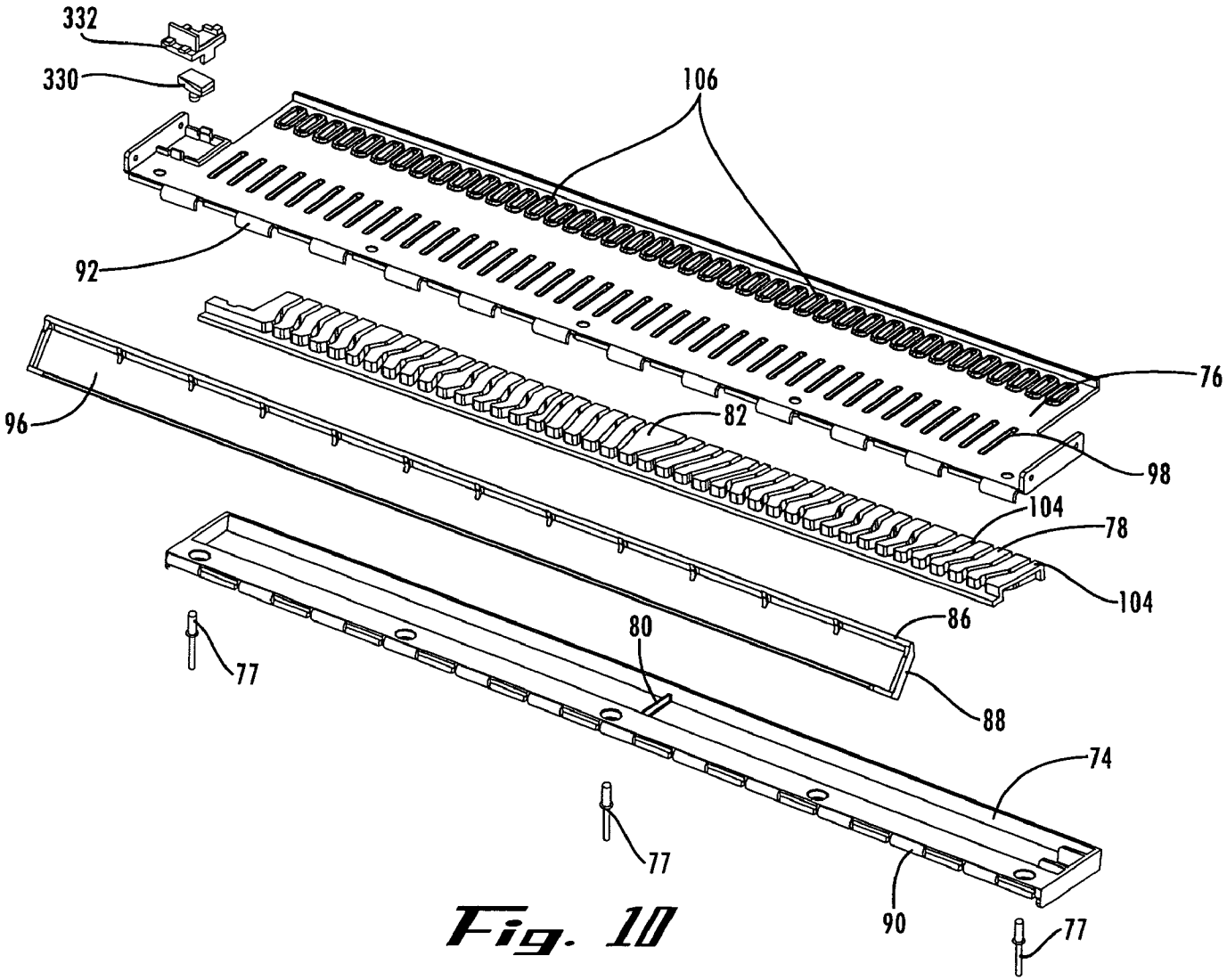
FIG. 10 is an exploded perspective view of the lockout assembly of FIG. 8.

As shown in exploded view in FIG. 10, lockout assembly 62 includes slide lock cover 74, which is connected to front bottom member 76 using fasteners 77. In this manner, slide lock cover 74 and front bottom member 76 enclose slide lock member 78. Flange 80 on slide lock cover 74 projects into centering notch 82 on the slide lock member 78 so that slide lock member 78 is self-centering. Projections in centering notch 82 create a close tolerance fit and hold the slide lock member 78 in position.

Hinge components 86 on the front lockout door 88 connect with alternating hinge components 90 and 92 on each of the slide lock cover 74 and the front bottom member 76. In this manner, front lockout door 88 is joined to both of the slide lock cover 74 and the front bottom member 76. In some embodiments, all of the hinges are integrally formed on those components. Lockout door 88 may be closed over the row of actuators (further described below), so that no product is accessible without the assistance of store personnel. Directions of use may be printed on the inside surface 96 of the lockout door 88 to aid a user when the lockout door 88 is open. Alternatively, other pertinent information may be printed on the inside surface 96 of the lockout door 88.

Each aperture 98 of front bottom member 76 is sized to receive a pin 100 that projects from a bottom surface of a pusher assembly unit 68 (further described below). Pin 100 passes through aperture 98 of front bottom member 76 and into channel 104 of the slide lock member 78. When the actuator 98 is depressed, the pin 100 moves toward the back of the cabinet in the channel 104. As shown in FIG. 10, channels 104 are shaped so that as a pin 100 is forced through a channel 104, the slide lock member 78 shifts to one side, blocking access to any other channels 104. Channels 104 vary in position and direction. Thus, only one pin 100 may be forced through any channel at a time. In this manner, only one pusher assembly unit 68 may be activated at a time.

A plurality of rear slots 106 of front bottom member 76 trap extended tabs (not shown) on the divider 70 and extended tabs 108 on the pusher assembly 68 (FIG. 21), securing the dividers 70 and pusher assembly units 68 in position. The dispenser module may easily be reconfigured to accommodate a variety of sizes and quantities of pusher assembly units. This ensures that the optimum amount of shelf space is utilized, providing maximum density and profitability to the retailer.

Figure 11:
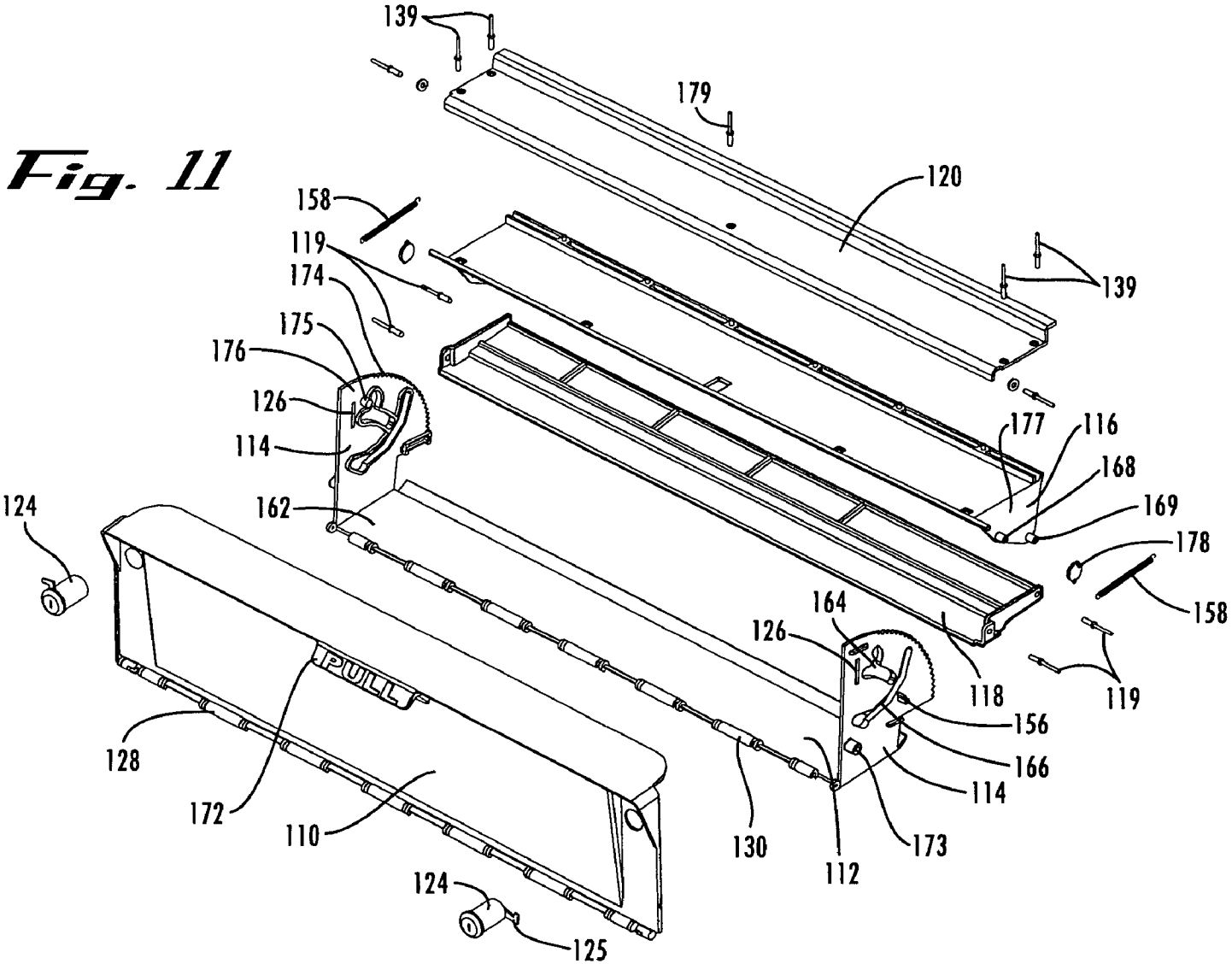
FIG. 11 is an exploded perspective view of the front door assembly of FIG. 7.
Figure 12:
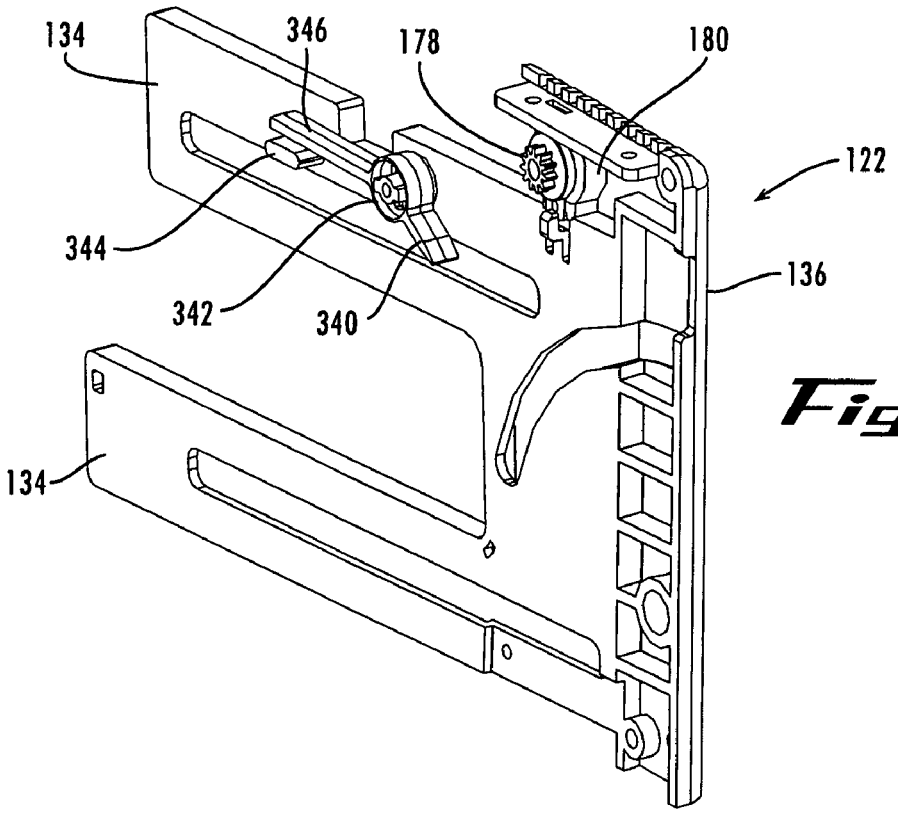
FIGS. 12 and 13 are perspective views of the slide assemblies of FIG. 7.
Figure 13:
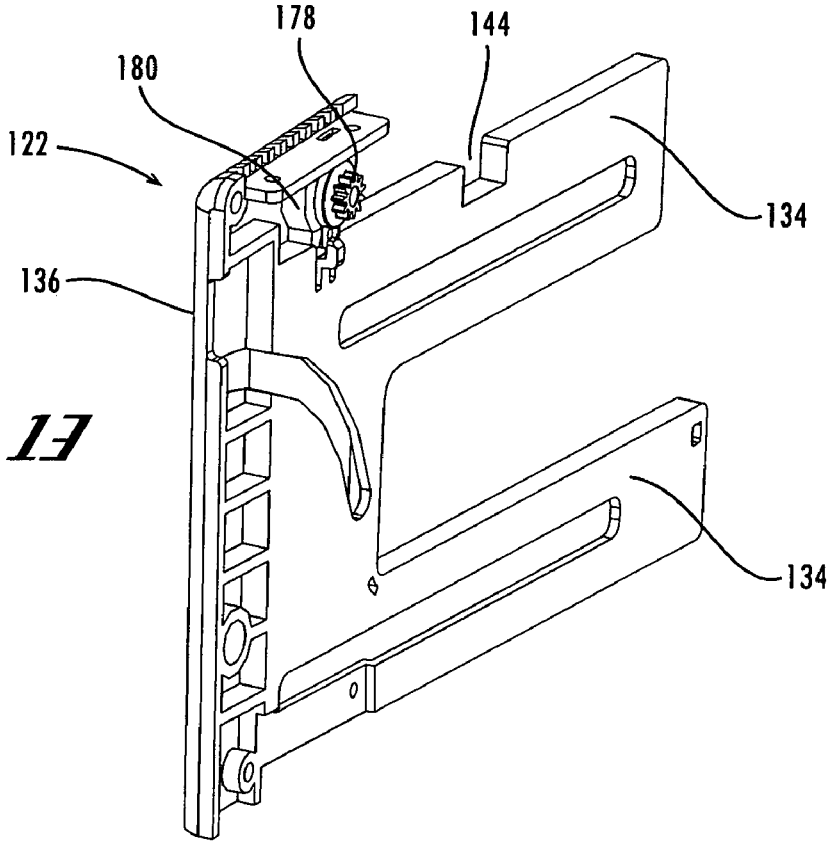

Door assembly 64, shown in exploded view in FIG. 11, includes a front panel 110, a main door member 112 having two side plates 114, an upper door 116, a front lower 118, a top cover 120, and two slide assembly components 122 (shown in FIGS. 12 and 13). Preferably, at least main door member 112, upper door 116, front lower 118 and front panel 110 are clear, so that the encased products can be viewed easily by purchasers. According to certain embodiments, components are constructed of a clear plastic or other material to allow viewing of the product and to take advantage of its lightweight, yet shatterproof properties. Preferably, the components are made of polycarbonate.

Certain embodiments of the theft deterrent system of this invention may be easily reconfigured and/or restocked by unlocking the front panel 110 of the door assembly 64. Keyed locks 124 are mounted in front panel 110. Arm 125 of lock 124 engages slot 126 of side plate 114 when in a locked position. Hinge components 128, 130 on each of the front panel 110 and the main door 112 are integrally formed on those components and join the two components together. In this manner, the front panel 110 easily swings downward to a fully open position to provide access to the modules when unlocked.

Slide assembly components 122, shown in FIGS. 12-13, provide the unit with a "drawer-like" capability. Slide assembly components 122 may be attached to side panel members 66 using any suitable mechanism. In certain embodiments, and as shown in the drawings, tabs 132 of side panels 66 secure slotted rails 134 of each slide assembly 122 to each of side panel members 66. In addition, slide assembly components 122 are attached to top cover 120 using any suitable fastener and are attached to the lockout assembly 62 at the front bottom region using one or more fastening rivets. Outer wall 136 of each slide assembly component 122 fits against an extension 138 on each side panel member 66 so that each outer wall 136 and side panel member 66 form a side of the cabinet assembly 50 (FIG. 7). Top cover 120 is attached to outer wall 136 using fasteners 139.

Figure 14:
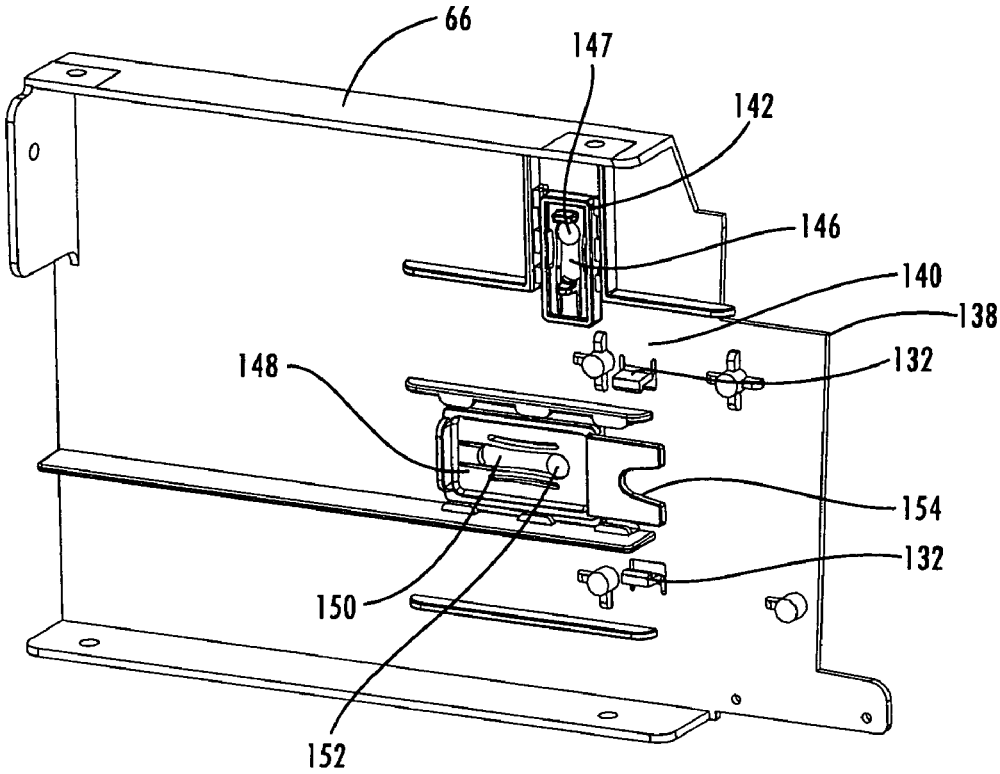
FIG. 14 is a perspective view of the right side door assembly of the module assembly of FIG. 7.

Slotted rails 134 of slide assembly components 122 slide in travel way 140 of side panel members 66 (shown in FIGS. 8 and 14). Vertical locking tabs 142 attached to side panel members 66 are each perforated by a slot 146 which receives a post 147 of side panel member 66 and which allows vertical locking tabs 142 to slide vertically along the length of slot 146. In order to slide out the door assembly 64 to reconfigure the dispenser module, vertical locking tabs 142 slide up and out of notch 144 in slotted rail 134 and out of travel way 140 so that the door assembly 64 may slide out of the cabinet.

Horizontal locking tabs 148 attached to side panel members 66 provide an additional lockout feature. Horizontal tabs 148 are perforated by a slot 150 which receives post 152 of side panel member 66 and allows horizontal tabs to slide forward and backward along the length of the slot 150. Sliding horizontal tabs 148 forward moves notch 154 of horizontal tab 148 over post 156 (FIG. 11) attached to side plate 114. Post 156 also secures one end of spring 158, further described below. Notch 154 traps post 156, preventing movement of side plate 114 so that door assembly 64 is locked in a closed position. In this manner, access to actuators 160 (further described below) is restricted.

Main door member 112 includes a bottom 162 and two side plates 114. Each side plate 114 is perforated by a slot 126, which receives arm 125 of lock member 124, described above. Each side plate 114 is also perforated by a Y-shaped opening 164 and a curved opening 166, each of which receives one of two pins of upper door 116. First pins 168 of upper door 116 fit into the upper section of the Y-shaped opening 164, while second pins 169 of upper door 170 are received in curved opening 166.

As described above, main door member 112 and front panel 110 are joined by integral hinges 128, 130. As also described above, when the front panel 110 is locked, front panel 110 is secured to main door member 112 and cannot rotate to open on hinge components 128, 130. Thus, when locked, front panel 110 and main door member 112 function and move as a single component. Pulling on handle 172 of front panel 110 causes front panel 110 and main door 112 to pivot open about hinge post 173. First, pins 168 of upper door 116 drop down in the Y-shaped opening 164 and second pins 169 move through the curved opening 166 until the one or both of the pins reach the end point of the either opening. In this manner, the end points of the openings function as a stop preventing the front panel 110 from being fully extended in a forward direction and also limiting the travel of the front panel 110 and the main door 112. Post 175 on side plate 114 provides a point about which downwardly extending sides 177 of upper door 116 rotate when the front panel and main door are opened. Blind rivet 179 is received in a tab (not shown) of top cover 120 and prevents upper door 116 from dislodging during use.

Gear teeth 174 on top curved surface 176 of the side plates 114 engage damper 178. One damper 178 is housed in each damper housing 180 on each slide assembly component 122. Door spring 158 urges the door assembly to a closed position. One end of each door spring 158 is attached to a post (not shown) on each slide assembly component 122 and the remaining end is attached to a post 156 on each side plate 114. In this manner, the dampers 178 prevent the front panel 110 and the main door 112 from slamming shut and also prevent any dispensed product from jamming the unit before it is removed from the product dispensing area.

In certain embodiments and as shown in the figures, each end of the front lower 118 is attached to slide assembly components 122 using blind rivets 119, but may be attached by any suitable means. Front lower 118 is positioned just above the buttons of the pusher assembly units, further described below, and maintains the position of the modules when the slide assembly is closed.

Figure 23:
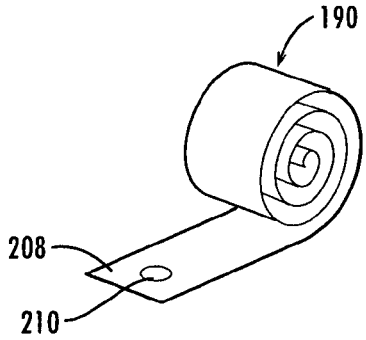
FIG. 23 is a perspective view of the spring of FIG. 16.
Figure 24:
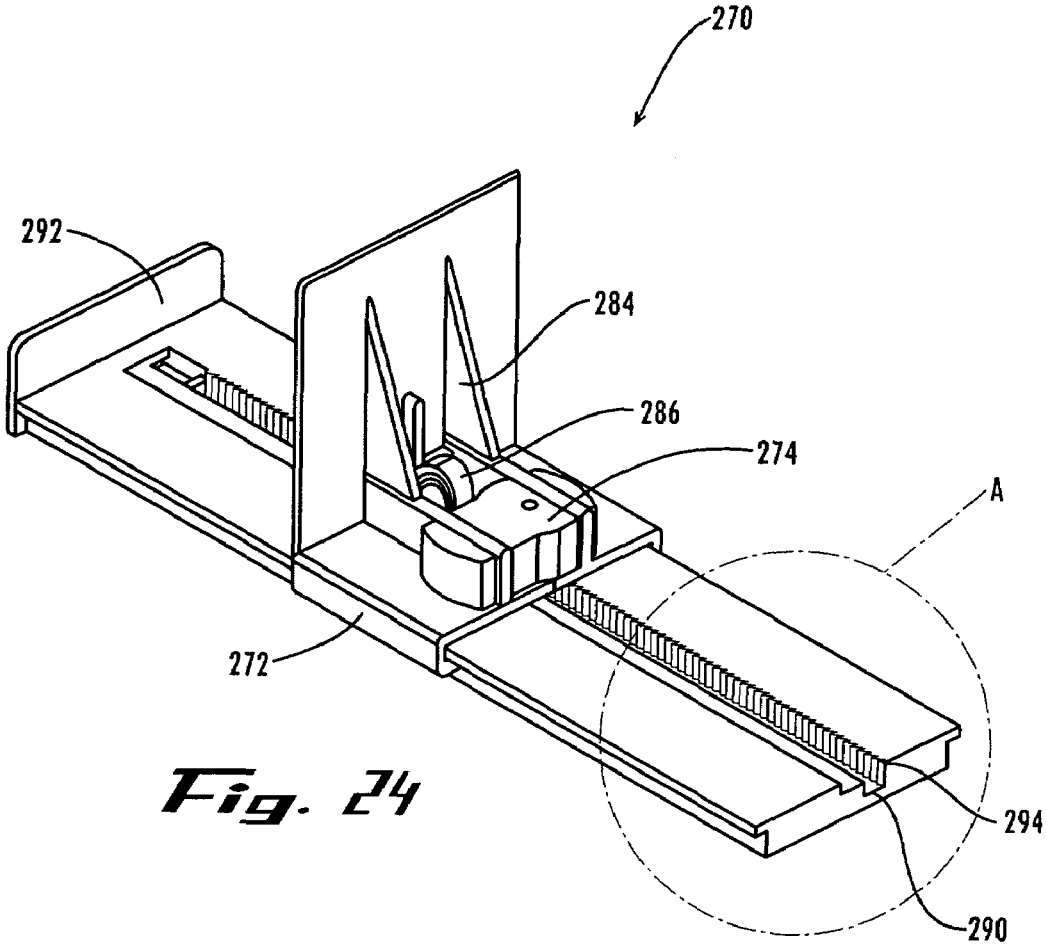
FIG. 24 is a perspective view of a pushing device according to embodiments of the invention.

Within each dispenser module is at least one pusher assembly unit 68 for advancing product, shown in FIGS. 16-19. The pusher assembly 68 includes a track 184 on which products are placed. The products are held in place and pushed forward by a pushing ram 188, which is held in tension by constant force spring 190 (FIG. 23). The pushing ram 188 keeps the next product to be dispensed against front lip 192. Thus, as a first product is removed from the shelf unit, the products located behind the one that was removed must move forward.

Figure 19:
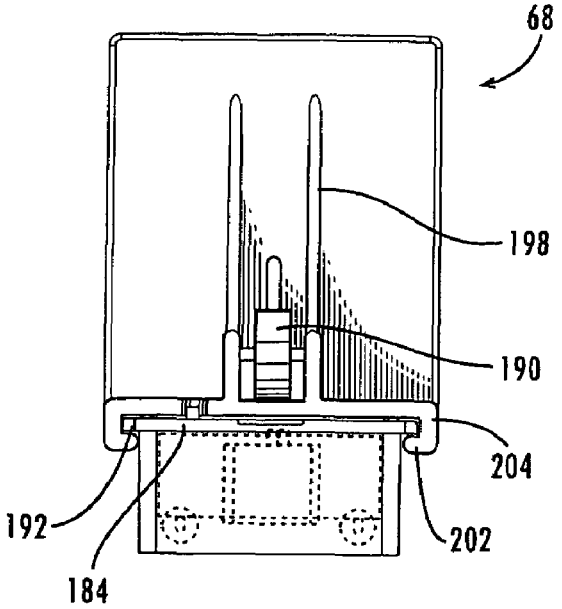
FIG. 19 is an end view of the pusher assembly of FIG. 16.
Figure 20:
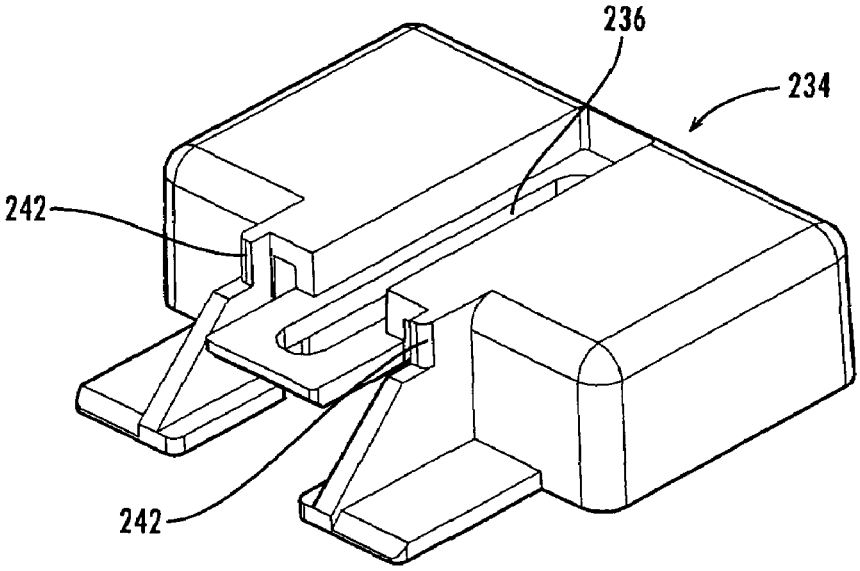
FIG. 20 is a perspective view of the button of FIG. 16.

Pushing ram 188 includes a front surface 194 for engaging product and a rear surface 196. According to embodiments, the pushing ram 188 is rectangular plate, although other suitable shapes and geometries may also be used. Pushing ram 188 includes gusset 198 (shown in FIG. 19), reinforcing pushing ram 188 and providing a housing for spring 190 (further described below). As shown in FIG. 19, extension 202 extends beyond the bottom portion 204 of pushing ram 188. In this manner, extension 202 engages lip 192 of track 184, so that pushing ram 188 is in sliding engagement with track 184.

Figure 17:
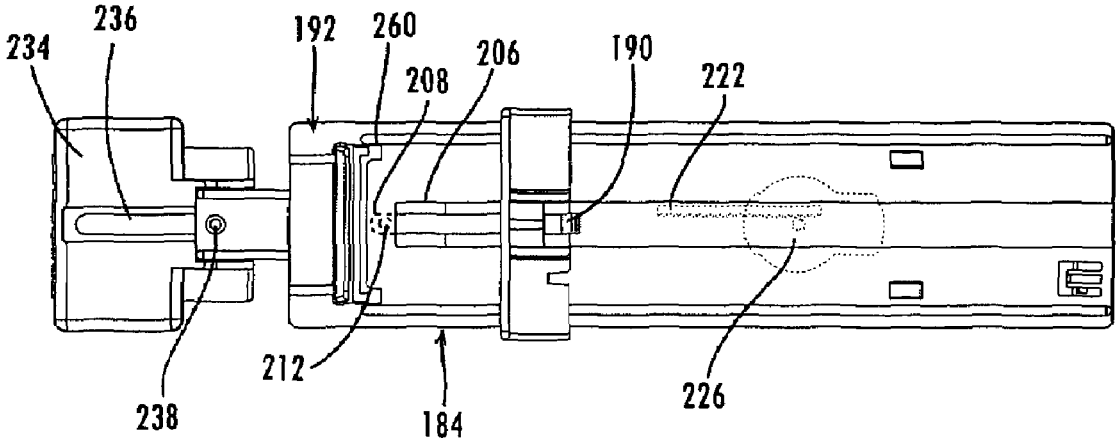
FIG. 17 is a top view of the pusher assembly of FIG. 16.

As shown in FIG. 17, spring 190 extends under the pushing ram 188, along track 184, and passes through front opening 206 in the track 184. End 208 of spring 190 includes aperture 210 that engages post 212 that projects downward from the bottom surface of the track 184. Spring 190 may also be attached to pusher assembly unit 68 in any other suitable manner. Movement of the pushing ram 188 toward the rear of the track 184 unwinds spring 190 so that spring 190 urges pushing ram 188 in the forward direction. The spring may preferably be a constant force spring, such as those sold under the trademark Conforce®, but many other types of springs, such as a variable force spring, may also be used. In certain embodiments, the spring is a stainless steel VULCAN PN# GP5D13AD spring that is 0.0050 inches thick by 0.250 inches wide by 13 inches long. The minimum force is 0.32 pounds and the maximum force is 0.80 pounds. Any other suitable spring may also be used.

Products can be loaded in pushing assembly unit 68 by forcing pushing ram 188 backwards along track 184 and placing multiple units of the product against the pushing ram 188. As described above, spring 190 causes the pushing ram 188 to exert force on the products towards the front of the track 184.

Figure 18:
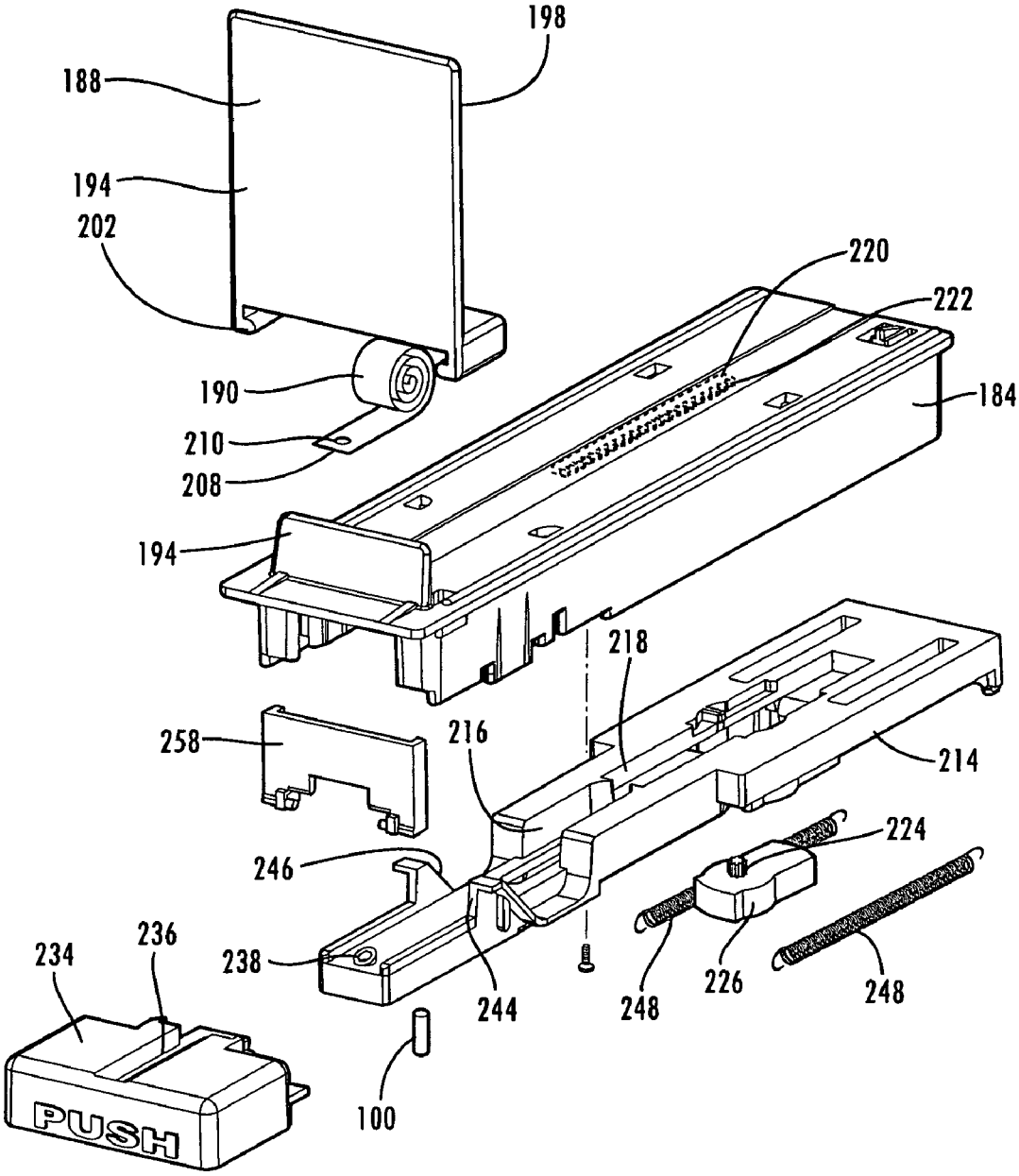
FIG. 18 is an exploded perspective view of the pusher assembly of FIG. 16.
Figure 21:
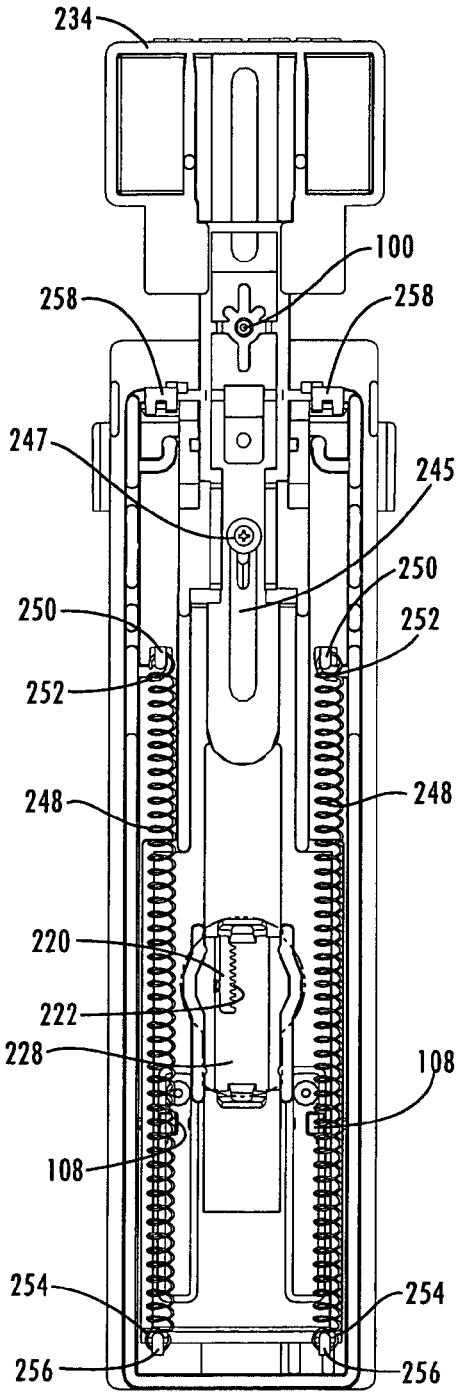
FIG. 21 is a bottom view of the pusher assembly of FIG. 16, shown without the motor.

As shown in FIGS. 18 and 21, lifter slide 214 includes a central channel 216 having side walls 218. A gear rack 220 having exposed gear teeth 222 is attached to one of side walls 218 along central channel 216 so that gear teeth 222 project into channel 216 and engage external gear 224 of the motor 226, as further described below. It should be understood that the gear teeth may be positioned in various other manners along the track 184 or lifter slide 214 and maintain the functionality of the pushing assembly.

Figure 22:
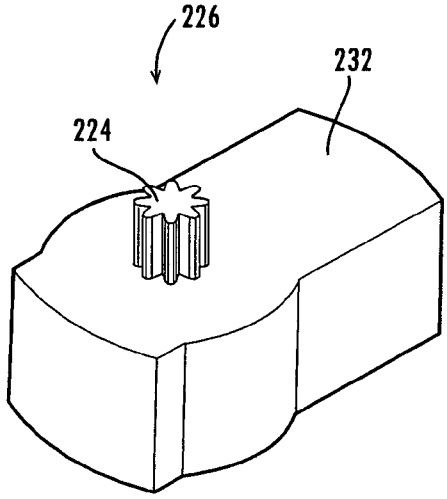
FIG. 22 is a perspective view of the motor of the pushing device of FIG. 16.

As shown in FIGS. 17-18 and 21, motor 226 is housed in cavity 228 on the bottom side 230 of lifter slide 214. Motor 226 includes a housing 232 and an external gear 224 (FIG. 22) and is positioned in cavity 228 so that external gear 224 extend up into channel 216 of lifter slide 214 and engage gear teeth 222. According to certain embodiments, one such motor is a resistance motor, such as the resistance motor Model #w217 sold by Vigor, although other types of motors may also be used.

Each pusher assembly unit 68 includes a product dispensing actuator, such as a button, lever or knob. According to certain embodiments and as shown in the Figures, the actuator is a mechanical button 234. A user pushes the button 234 to release a product. Button 234 includes slot 236 through which a post and snap member 238 of lifter slide 214, or any other suitable attachment mechanism, passes. In this manner, button 234 is connected to lifter slide 214 and button 234 slides freely along the length of the slot 236.

When button 234 is depressed and thereby moved in a rearward direction, stop 242 of button 234 contacts the forward edge 244 of ramp 246 of lifter slide 214, pushing lifter slide 214 in a rearward direction. As shown in FIG. 21, lifter slide 214 is perforated by a slot 245 through which assembly screw 247 passes, allowing lifter slide 214 to move along the length of slot 245. Assembly screw 247 is threaded to a post (not shown) in track 184, thereby connecting lifter slide 214 and track 184.

Continued depression of button 234 extends lifter springs 248, which are secured to the bottom of the lifter slide 214 and to the track 184. One end 252 of each spring 248 is attached to a hook 250 on track 184, while the second end 254 of each spring 248 is attached to a hook 256 on lifter slide 214, as shown in FIG. 21. In this manner, springs 248 urge lifter slide 214 in a forward direction. It should be noted that pulling on button 234 does not substantially speed up travel of lifter slide 214 to its forward most position, preventing a user from speeding up the time delay feature manually.

Depressing the button 234 forces the lifter slide 214 in a rearward direction so that the lifter 258 is forced to slide up ramp 246 and through track opening 260. Lifter 258 lifts the next product held against lip 192 by pushing ram 188. Because of the tension in the spring 190, pushing ram 188 pushes the lifted product forward over the lip 192 and into the product dispensing area. The user then opens the front panel 110 to remove the product. As described above, opening front panel 110 causes the upper door 116 to drop down and meet main door 112, blocking access to the next product. In this manner, no other products are accessible to the user.

As one product is removed, the force of the spring 190 causes the pushing ram 188 to move forward along the track 184 until the first of the remaining products contact the lifter 258. As the lifter slide 214 returns to its forward most position, the lifter 258 retracts causing the pushing ram 188 to advance the first product until the product contacts the lip 192 and is positioned above the lifter.

The resistance motor 226 substantially reduces the speed at which the lifter slide 214 returns to its forward position. The internal gears of the resistance motor are preferably configured to provide resistance to the forward movement by limiting the rotation of the external gear 224. Because the external gear 224 engages gear teeth 222 of gear rack 220 and the external gear rotation is limited, the movement of the lifter slide 214 toward button 234 is substantially slowed.

Figure 25:
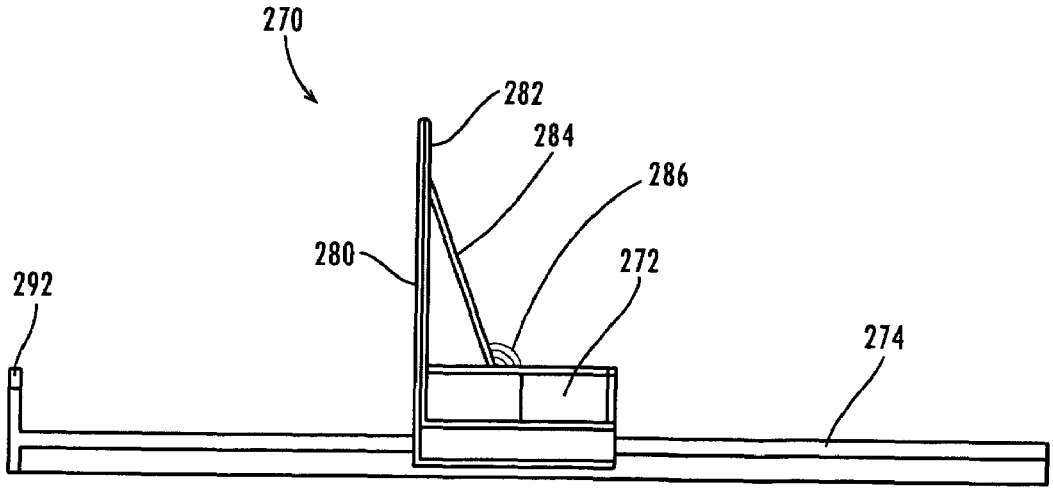
FIG. 25 is a side view of the pushing device of FIG. 24.
Figure 26:
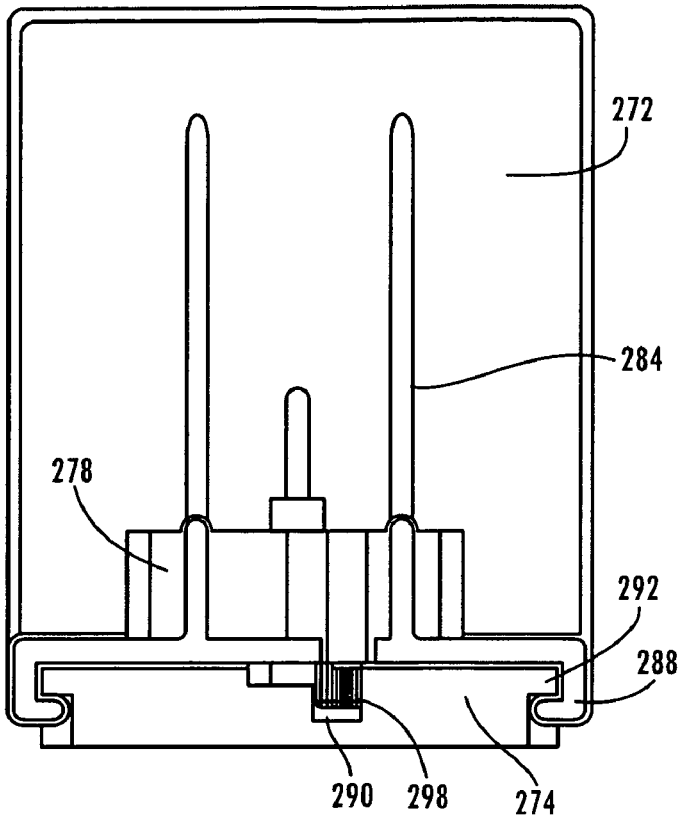
FIG. 26 is a rear view of the pushing device of FIG. 24.
Figure 27:
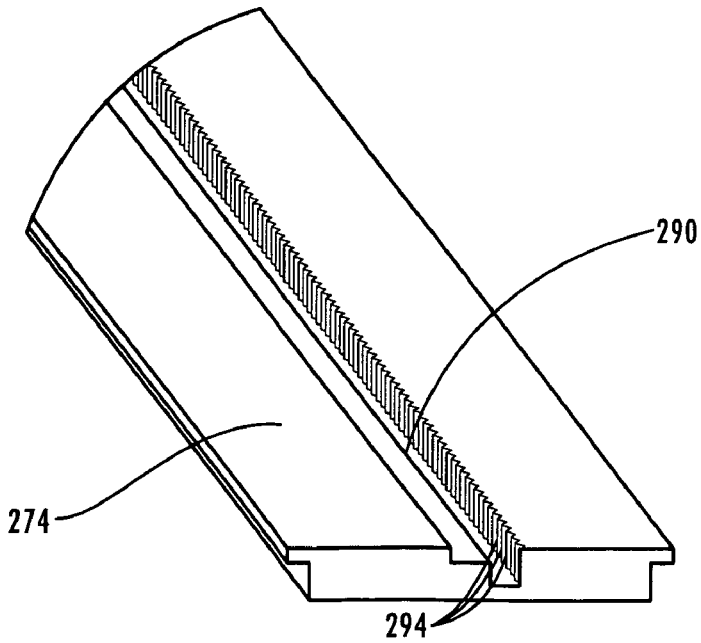
FIG. 27 is an enlarged detail view taken at A in FIG. 24.
Figure 28:
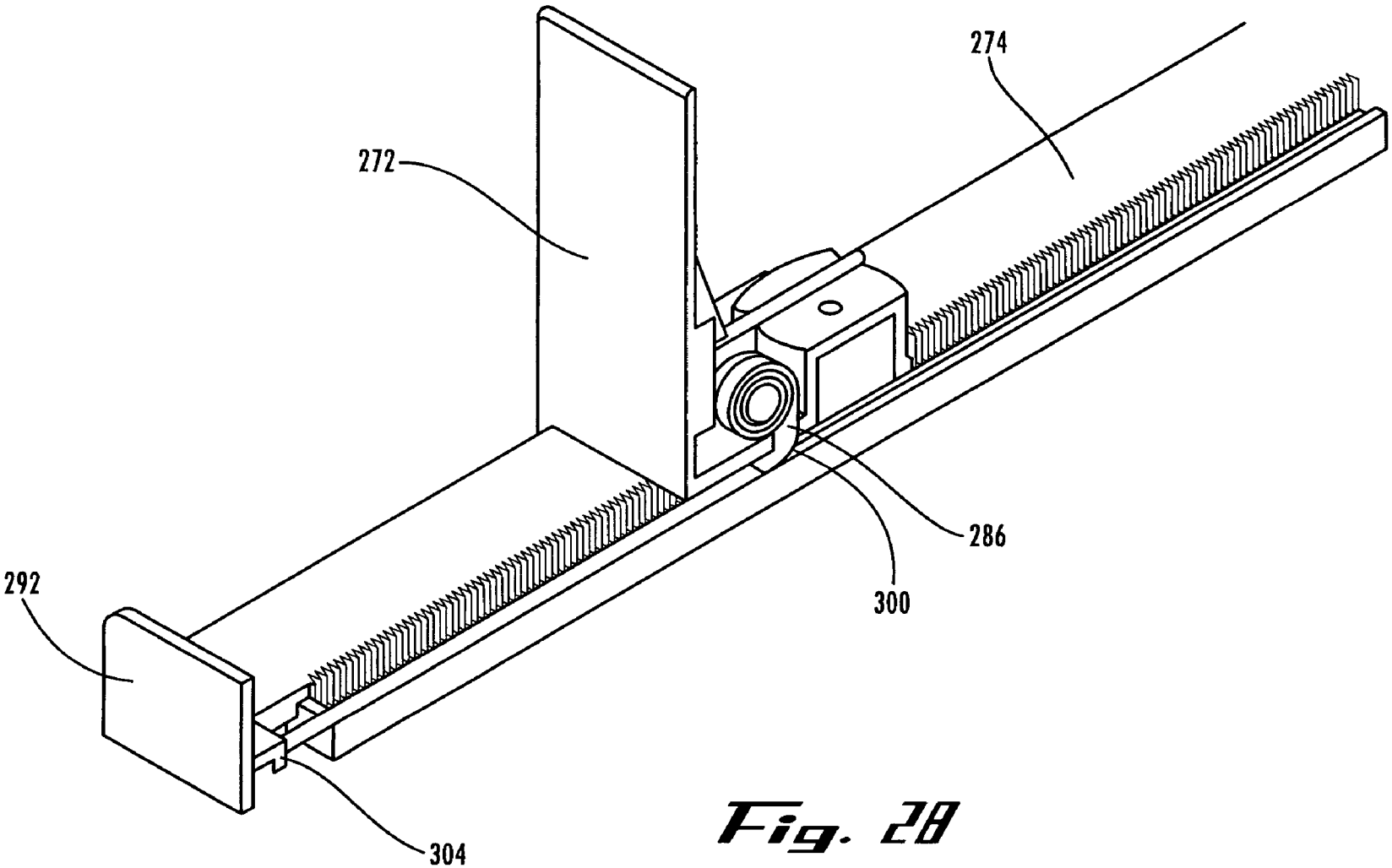
FIG. 28 is a perspective view in partial cross-section of the pushing device of FIG. 24.
Figure 29:
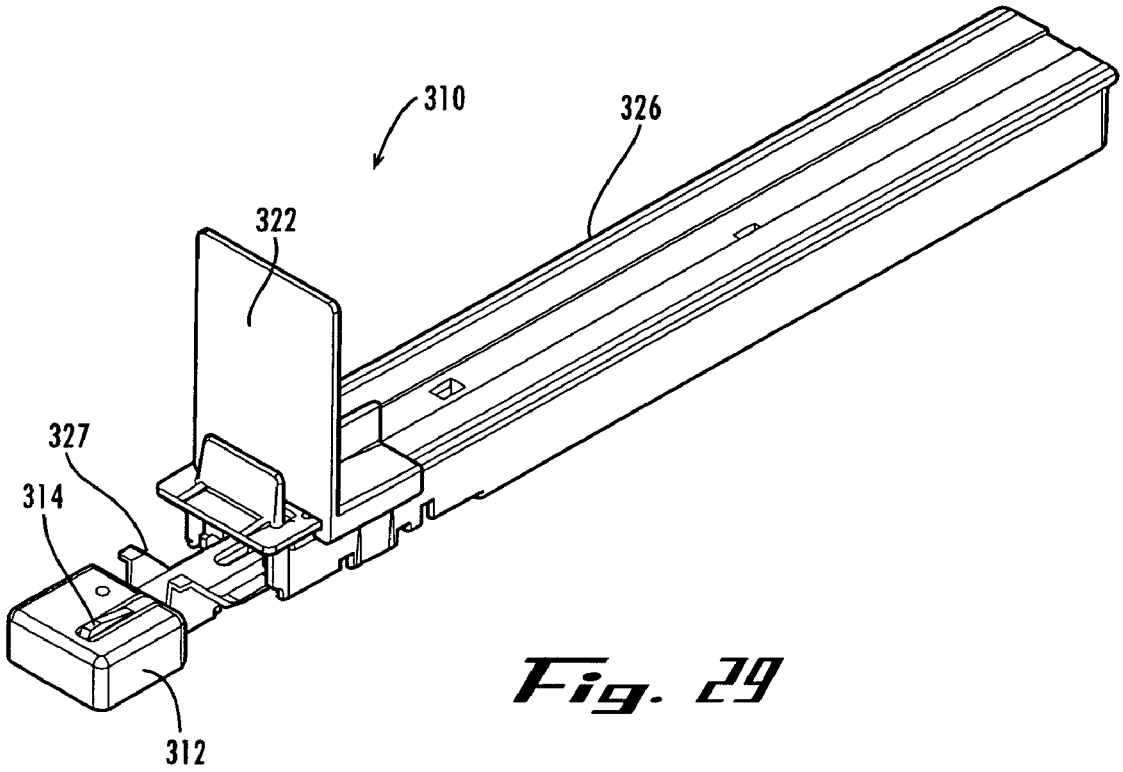
FIG. 29 is a perspective view of an alternative embodiment of a pusher assembly of this invention.
Figure 30:
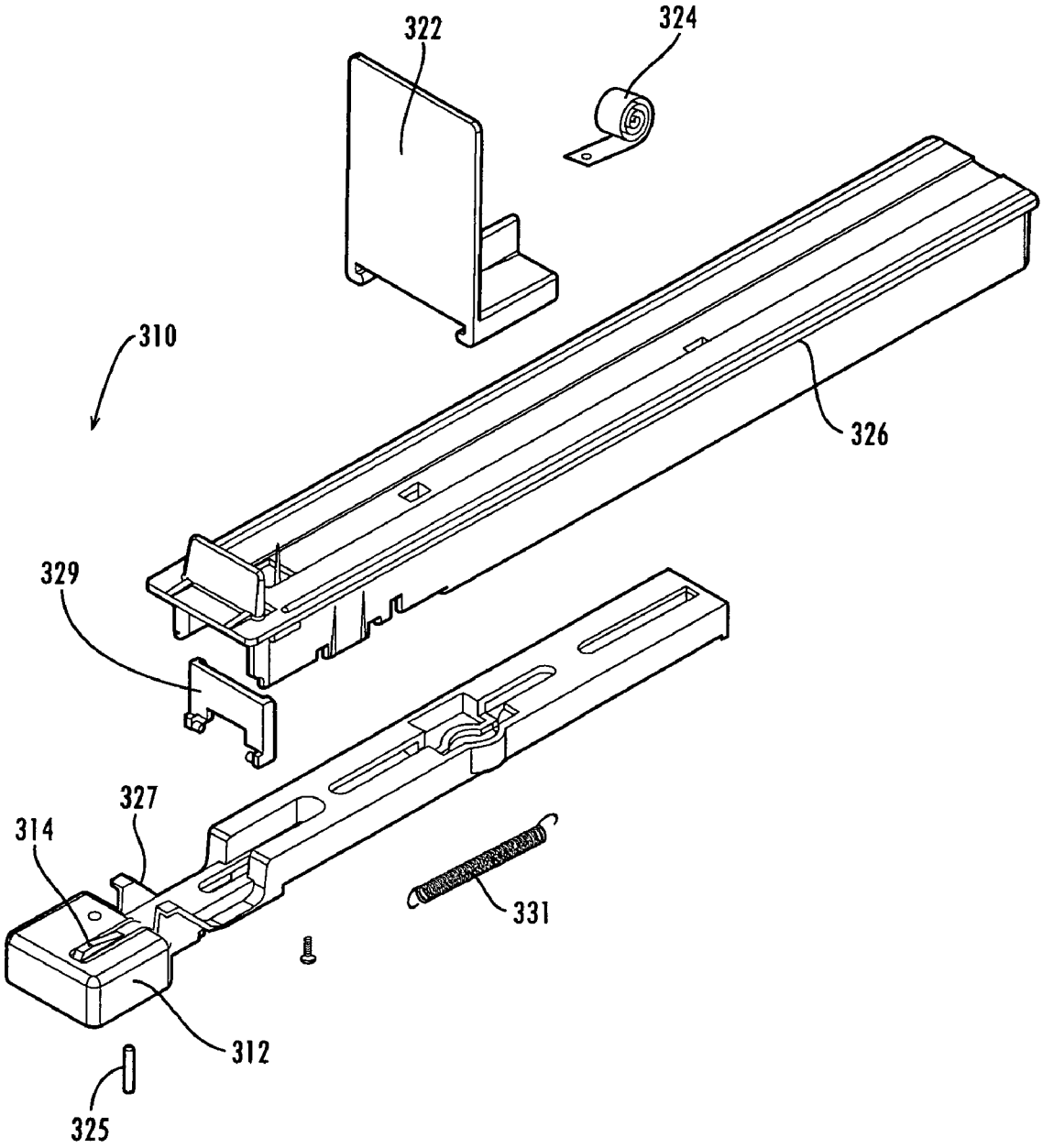
FIG. 30 is an exploded perspective view of the pusher assembly of FIG. 29.
Figure 31:
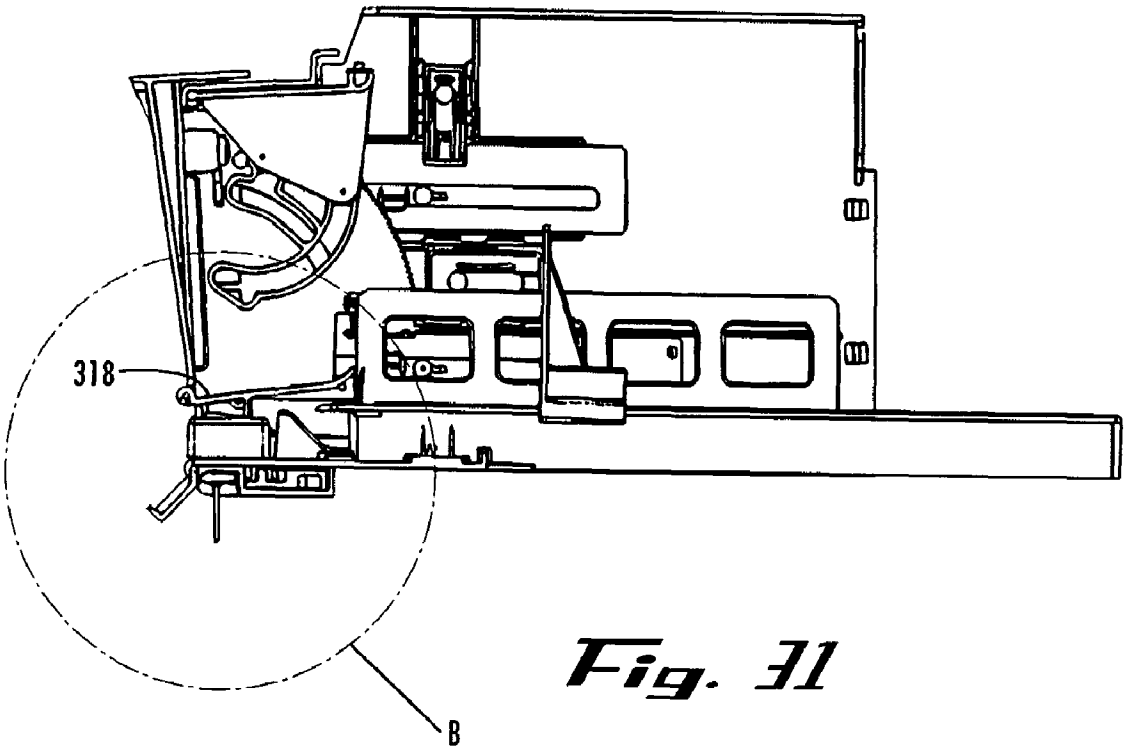
FIG. 31 is a side view of a portion of a cabinet assembly for use with the alternative embodiment of the pusher assembly shown in FIG. 29.
Figure 32:
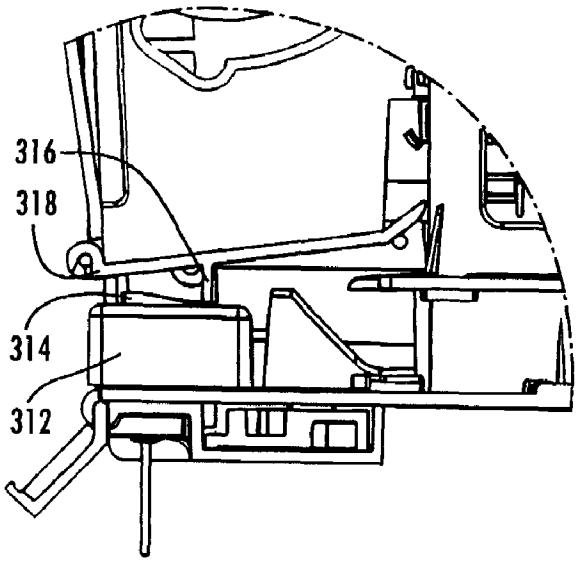
FIG. 32 is an enlarged detail view taken at B in FIG. 31.

In certain alternative embodiments of a pusher assembly of this invention, shown in FIGS. 24-28, the pusher assembly 270 comprises a pushing ram 272, a track 274, and a motor 278. Pushing ram 272 engages product (not shown) and pushes product forward. As shown in FIGS. 25 and 28, pushing ram 272 includes a front surface 280 for engaging product and a rear surface 282. Pushing ram 272 includes gusset 284 (shown in FIG. 25), reinforcing pushing ram 272 and providing a housing for spring 286 (further described below).

As shown in FIG. 26 and similar to the embodiments described above, extension 288 of pushing ram 272 extends beyond the bottom portion of pushing ram 272. In this manner, extension 288 engages lip 292 of track 274, so that pushing ram 272 is in sliding engagement with track 274.

As shown in FIG. 27, track 274 includes a central channel 290 having side walls. Exposed gear teeth 294 on a side wall of the central channel 290 project into channel 290 and engage external gear of the motor 278. It should be understood that the gear teeth may be positioned in various other manners along the track and maintain the functionality of the pushing assembly. Motor 278 is attached to pushing ram 272 and includes a housing and an external gear 298. Motor 278 is positioned on pushing ram 272 so that external gear 298 extend into channel 290 of track 274 and engage gear teeth 294.

As shown in FIG. 28, spring 286 extends through a small slot 300 and an aperture in the end of the spring 286 engages a post 304 on the track 274. Spring 286 may also be attached to pusher assembly in any other suitable manner. Movement of pushing ram 272 toward the back end of the track 274 unwinds spring 286 so that spring 286 urges pushing ram 272 in the forward direction. The spring may preferably be a constant force spring, such as those sold under the trademark Conforce®, but many other types of springs, such as a variable force spring, may also be used.

Product can be loaded into the pusher assembly 270 by forcing pushing ram 272 backwards along track 274 and placing multiple units of the product against the pushing ram 272. A lip or wall may be located at the front of the display device so that the multiple units of product are located between the pushing ram and the lip. As described above, spring 286 causes the pushing ram 272 to exert force on the products towards the front of the track 274. Resistance motor preferably allows pushing ram to be forced backwards freely for loading of the product.

As one product is selected from the front of the pusher assembly 270, the compression of the spring 286 causes pushing ram 272 to move forward and the external gear 298 to rotate along gear teeth 294. This in turn causes the remaining product to move forward along track 274 until the remaining products engage the front lip 292. Resistance motor 278, however, substantially reduces the speed of this forward progression. The internal gears of the resistance motor are preferably configured to provide resistance to the forward movement by limiting the rotation of the external gear. Because the external gear engage the gear teeth of the track and the external gear rotation is limited, the movement of the pushing ram and therefore the remaining product to the front of the track is substantially slowed.

In other alternative embodiments, for example as shown in FIGS. 29-32, the time delay feature is associated with the button and the door assembly, and no motor is used. As shown in the Figures, pusher assembly 310 has button 312 including tab 314. When the button is depressed, the tab 314 is depressed under locking rib 316 on main door 318 (shown in FIGS. 31 and 32). Tab 314 is forced downward and passes under locking rib 316, but springs back up on the rear side of locking rib 316, so that button 312 is locked in a depressed position. When front panel 320 and main door 318 are opened to remove a product, locking rib 316 is raised up, releasing tab 314 and allowing button 312 to return to a ready-to-dispense position. Pusher assembly 310 also includes a pushing ram 322, pin 325 and spring 324 attached to a track 326, a lifter slide 328 and lifter 329, all of which function as described above for the embodiment shown in FIG. 18. Spring 331 functions similar to springs 248 described above to return the lifter slide to the ready to dispense position.

Certain embodiments of the anti-theft system may include a sound to alert store employees that a product is being dispensed. The system preferably includes means for producing a clearly audible sound. For example, the system may include a clicker for providing an audible clicking sound. The clicker may be incorporated into a spring so that the sound is heard when the spring is recoiled after engaging the actuator. As shown in FIG. 12, arm 340 of clicker 342 engages gear teeth 174 of a side plate 114 when the front panel 110 and main door 112 are opened, causing a clicking sound as the arm 340 passes over each of the gear teeth 174. Stop post 344 blocks downward movement of rear arm 346 so that arm 340 is trapped against the gear teeth 174 while the door is being opened.

In other embodiments, the sound producing mechanism may be incorporated into the resistance motor and may produce a ratchet sound. In other embodiments, the system can include an audible beeping sound. For example, engaging the actuator may activate an electronically produced beeping sound or an audible message when a product is dispensed. The audible sound alerts persons in the vicinity that a product is in the position to be removed. This may attract the attention of a store clerk or others and deter thieves or the removal of multiple product units.

In certain embodiments and as shown in FIG. 10, switch 330 and cover 332, interact with the notch of the slide lock, allowing the switch to open and close, sending a signal via a transmitter (not shown) to a PA system. An audible tone then alerts store personnel that the cabinet is being accessed. In another embodiment, an additional switch is provided which is triggered if the front door is opened too long. In one embodiment, a transmitter unit is triggered by opening the dispenser module. The transmitter then transmits a signal to a receiver that may or may not be remotely located.

The foregoing description is provided for describing various embodiments and structures relating to the invention. Various modifications, additions and deletions may be made to these embodiments and/or structures without departing from the scope and spirit of the invention.

The invention claimed is:

1. A product dispensing system comprising:

(a) at least one product dispensing unit;

(b) an adjustable product dispensing unit housing that may be reconfigured to house various sized product dispensing units; and (c) at least one theft deterring mechanism comprising:

(i) a plurality of actuators accessible to a user, each actuator cooperating with a pin, and (ii) a lockout bar comprising a plurality of channels configured to accept a pin associated with an actuator, wherein the channels are shaped so that when a pin associated with an actuator enters a channel, the lockout bar shifts, preventing access to the remaining channels; and (d) at least one pusher system wherein each of the at least one pusher systems comprises:

(i) a track;

(ii) a pushing ram in sliding engagement with the track; and (iii) a spring that urges the pushing ram toward the front of the track.

2. The system of claim 1, further comprising a resistance mechanism coupled with the pushing ram, wherein the resistance mechanism controls forward movement of the pushing ram along the track.

3. The system of claim 1, wherein each of the at least one pusher systems further comprises a product lifter housed under an aperture in the track, wherein activation of the system lifts the product lifter through the aperture and lifts a product resting on the product lifter above a front lip of the track, allowing the force of the spring to push the product over a top of the front lip.

4. The system of claim 2, wherein the track further comprises a channel.

5. The system of claim 1, wherein the channel further comprises gear teeth that project into the channel.

6. The system of claim 2, wherein the resistance mechanism further comprises an external gear component.

7. The system of claim 1, further comprising:

(i) a resistance mechanism; and (ii) a button accessible to the user and attached to the resistance mechanism, the button having a ready position wherein activation of the button from the ready position to an activated position causes a product to be dispensed, and wherein the resistance mechanism delays the button returning to the ready position.

8. The system of claim 1, further comprising a sound producing mechanism.

9. The system of claim 4, further comprising a door assembly comprising:

(i) a front panel;

(ii) a bottom panel; and (iii) an upper panel, wherein when the front panel is opened, the bottom panel and the upper panel move together, blocking access to any product inside the housing.

10. The system of claim 1, wherein each of the plurality of actuators cooperates with one of the at least one pusher systems, and wherein when one of the plurality of actuators is activated, the pin associated with that actuator enters a channel of the lockout bar.

11. The system of claim 9, wherein the bottom panel and the front panel are integrally joined.

12. The system of claim 9, wherein the door assembly further comprises a lock associated with the door assembly, the lock having an unlocked position and a locked position, wherein the front panel and the bottom panel are secured together when the lock is in the locked position so that the front panel cannot be opened.

13. The system of claim 9, the door assembly further comprising a spring, wherein the spring urges the door assembly to a closed position.

14. The system of claim 13, further comprising gear teeth and a damper.

15. The system of claim 3, wherein each of the at least one pusher systems further comprises a lifter slide coupled to the track, wherein activation of the system moves the lifter slide from a starting position to an extended position, and wherein when in the extended position, the lifter slide lifts the product lifter.

16. The system of claim 15, further comprising a resistance mechanism that slows the speed at which the lifter slide returns to the starting position.

17. The system of claim 4, further comprising a plurality of product dispensing units.

18. The system of claim 1, wherein the channels vary in position and direction so that only one pin may move through any of the channels at a time.

* * * * *

UNITED STATES PATENT AND TRADEMARK OFFICE

CERTIFICATE OF CORRECTION

PATENT NO. : 7,641,072 B1
APPLICATION NO. : 11/528032
DATED : January 5, 2010
INVENTOR(S) : Vlastakis et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 302 days.

Signed and Sealed this

Sixteenth Day of November, 2010

David J. Kappos

David J. Kappos
*Director of the United States Patent and Trademark Office*